US009034545B2

(12) United States Patent
Maruyama et al.

(10) Patent No.: US 9,034,545 B2
(45) Date of Patent: May 19, 2015

(54) ELECTROPHOTOGRAPHIC PHOTOSENSITIVE MEMBER, METHOD FOR PRODUCING ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Akihiro Maruyama, Mishima (JP); Harunobu Ogaki, Suntou-gun (JP); Yuki Yamamoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 3 days.

(21) Appl. No.: 14/078,502

(22) Filed: Nov. 12, 2013

(65) Prior Publication Data

US 2014/0154617 A1 Jun. 5, 2014

(30) Foreign Application Priority Data

Nov. 30, 2012 (JP) ..... 2012-263257
Oct. 29, 2013 (JP) ..... 2013-224422

(51) Int. Cl.

| | |
|---|---|
| ***G03G 5/05*** | (2006.01) |
| ***G03G 5/07*** | (2006.01) |
| ***G03G 5/047*** | (2006.01) |
| ***G03G 5/06*** | (2006.01) |
| ***G03G 5/147*** | (2006.01) |

(52) U.S. Cl.

CPC ..... *G03G 5/078* (2013.01); *G03G 5/047* (2013.01); *G03G 5/0578* (2013.01); *G03G 5/0614* (2013.01); *G03G 5/14773* (2013.01)

(58) Field of Classification Search

USPC ..... 430/58.05, 58.2, 59.6

See application file for complete search history.

(56) References Cited

U.S. PATENT DOCUMENTS

| | | | |
|---|---|---|---|
| 5,049,617 | A | 9/1991 | Yoshioka et al. |
| 5,206,328 | A | 4/1993 | Okamura et al. |
| 5,248,750 | A | 9/1993 | Takarada et al. |
| 5,256,754 | A | 10/1993 | Takarada et al. |
| 7,875,410 | B2 | 1/2011 | Ogaki et al. |
| 7,901,855 | B2 | 3/2011 | Ogaki et al. |

(Continued)

FOREIGN PATENT DOCUMENTS

| | | | |
|---|---|---|---|
| JP | 2-88639 | A | 3/1990 |
| JP | 3-234768 | A | 10/1991 |

(Continued)

OTHER PUBLICATIONS

European Search Report dated Apr. 4, 2014 in European Application No. 13193401.0.

*Primary Examiner* — Peter Vajda

(74) *Attorney, Agent, or Firm* — Fitzpatrick, Cella, Harper and Scinto

(57) ABSTRACT

A charge-transporting layer of an electrophotographic photosensitive member has a matrix-domain structure having a domain which comprises at least one resin selected from the group consisting of a resin A1 a resin A2 and a specific silicone oil, and a matrix which comprises resin C and a charge-transporting substance, wherein a content of the structural unit represented by the formula (A-1) and the structural unit represented by the formula (A-2) is from 10% by mass to 40% by mass based on the total mass of the resin A1 and the resin A2.

10 Claims, 1 Drawing Sheet

(56) References Cited

U.S. PATENT DOCUMENTS

| | | | | |
|---|---|---|---|---|
| 2010/0092208 | A1* | 4/2010 | Ogaki et al. | 399/111 |
| 2012/0243904 | A1 | 9/2012 | Okuda et al. | |
| 2014/0023961 | A1 | 1/2014 | Okuda et al. | |
| 2014/0093815 | A1 | 4/2014 | Yamamoto et al. | |
| 2014/0154618 | A1 | 6/2014 | Maruyama et al. | |

FOREIGN PATENT DOCUMENTS

| | | | |
|---|---|---|---|
| JP | 4-168126 | A | 6/1992 |
| JP | 4-169589 | A | 6/1992 |
| JP | 2007-79555 | A | 3/2007 |
| JP | 2010-66669 | A | 3/2010 |
| WO | 2010/008095 | A1 | 1/2010 |

* cited by examiner

ELECTROPHOTOGRAPHIC PHOTOSENSITIVE MEMBER, METHOD FOR PRODUCING ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus including the electrophotographic photosensitive member.

2. Description of the Related Art

As an electrophotographic photosensitive member included in an electrophotographic apparatus, electrophotographic photosensitive members containing organic photoconductive substances have been earnestly developed. An electrophotographic photosensitive member generally contains a support and a photosensitive layer formed on the support and containing an organic photoconductive substance. Furthermore, the photosensitive layer is generally of a laminated type (a successive layer type) containing a charge-generating layer and a charge-transporting layer stacked in this order on the support.

In electrophotographic process, the surface of an electrophotographic photosensitive member is brought into contact with various materials including a developer, a charging member, a cleaning blade, paper and a transferring member (which are hereinafter sometimes generically designated as "contact members"). Therefore, one of characteristics required of an electrophotographic photosensitive member is reduction of image degradation derived from contact stress caused by these contact members. In particular, in accordance with recent improvement in the durability of an electrophotographic photosensitive member, further improvement is demanded in persistence of the effect of reducing image degradation derived from the contact stress and suppression of potential variation in repeated use.

With respect to persistent relaxation of the contact stress and suppression of potential variation in repeated use of an electrophotographic photosensitive member, International Publication No. WO2010/008095 proposes a method for forming a matrix-domain structure in a surface layer by using a siloxane resin in which a siloxane structure is incorporated into a molecular chain. This publication describes that the persistent relaxation of the contact stress and the suppression of potential variation in repeated use of an electrophotographic photosensitive member can be both attained by using a polyester resin having a specific siloxane structure incorporated thereinto.

Although the electrophotographic photosensitive member disclosed in International Publication No. WO2010/008095 attains both of the persistent relaxation of the contact stress and the suppression of potential variation in repeated use, further improvement is demanded in order to realize an electrophotographic apparatus operable at a higher speed and capable of producing a larger number of printed copies. As a result of study made by the present inventors, it has been revealed that further improvement can be achieved by allowing an electrophotographic photosensitive member to contain a specific compound in forming a matrix-domain structure.

SUMMARY OF THE INVENTION

An object of the present invention is to provide an electrophotographic photosensitive member and a method for producing the same in which persistent relaxation of contact stress and suppression of potential variation in repeated use of an electrophotographic photosensitive member are both achieved at a high level. Another object is to provide a process cartridge and an electrophotographic apparatus including the electrophotographic photosensitive member.

The present invention relates to an electrophotographic photosensitive member including: a support; a charge-generating layer formed on the support; and a charge-transporting layer formed on the charge-generating layer, in which the charge-transporting layer is a surface layer of the electrophotographic photosensitive member, and the charge-transporting layer has a matrix-domain structure having: a domain which includes a silicone oil having a structural unit represented by the following formula (O-1), and at least one group selected from the group consisting of an alkyl group having 2 to 30 carbon atoms, a polyether group, an aralkyl group, an epoxy group, and an allyl group; and at least one resin selected from the group consisting of a resin A1 having a structural unit represented by the following formula (A-1) and a structural unit represented by the following formula (B), and a resin A2 having a structural unit represented by the following formula (A-2) and a structural unit represented by the following formula (B); and a matrix which includes a resin C having a structural unit represented by the following formula (C) and a charge-transporting substance, and a content of the structural unit represented by the formula (A-1) and the structural unit represented by the formula (A-2) is from 10% by mass to 40% by mass based on the total mass of the resin A1 and the resin A2:

(A-1)

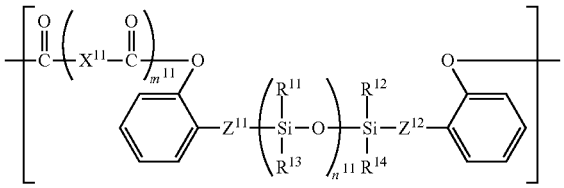

where, $m^{11}$ represents 0 or 1, $X^{11}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Z^{11}$ and $Z^{12}$ each independently represents an alkylene group having 1 to 4 carbon atoms, $R^{11}$ to $R^{14}$ each independently represents an alkyl group having 1 to 4 carbon atoms, or a phenyl group, $n^{11}$ represents the repetition number of a structure within brackets, and an average of $n^{11}$ in the resin A1 ranges from 20 to 150, (A-2)

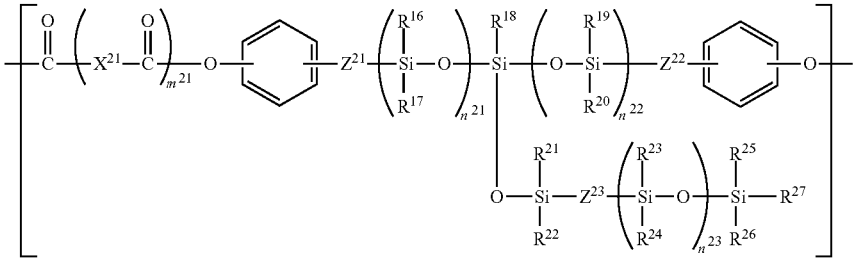

where, $m^{21}$ represents 0 or 1, $X^{21}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Z^{21}$ to $Z^{23}$ each independently represents an alkylene group having 1 to 4 carbon atoms, $R^{16}$ to $R^{27}$ each independently represents an alkyl group having 1 to 4 carbon atoms, or a phenyl group, $n^{21}$, $n^{22}$ and $n^{23}$ each independently represents the repetition number of a structure within brackets, an average of $n^{21}$ in the resin A2 ranges from 1 to 10, an average of $n^{22}$ in the resin A2 ranges from 1 to 10, and an average of $n^{23}$ in the resin A2 ranges from 20 to 200, (B)

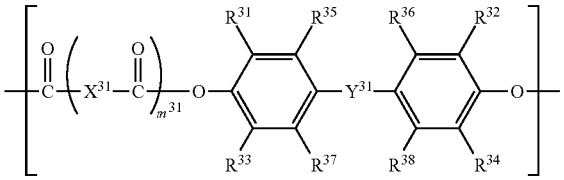

where, $m^{31}$ represents 0 or 1, $X^{31}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Y^{31}$ represents a single bond, a methylene group, an ethylidene group, a propylidene group, a cyclohexylidene group, a phenylmethylene group, a phenylethylidene group or an oxygen atom, and $R^{31}$ to $R^{38}$ each independently represents a hydrogen atom or a methyl group, (C)

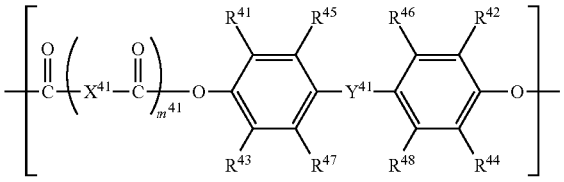

where, $m^{41}$ represents 0 or 1, $X^{41}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Y^{41}$ represents a single bond, a methylene group, an ethylidene group, a propylidene group, a cyclohexylidene group, a phenylmethylene group, a phenylethylidene group or an oxygen atom, and $R^{41}$ to $R^{48}$ each independently represents a hydrogen atom or a methyl group, (O-1)

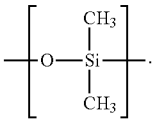

Furthermore, the present invention relates to a process cartridge detachably attachable to a main body of an electrophotographic apparatus, the process cartridge integrally supports, the electrophotographic photosensitive member, and at least one device selected from the group consisting of a charging device, a developing device, a transferring device and a cleaning device.

Moreover, the present invention relates to an electrophotographic apparatus including the electrophotographic photosensitive member, a charging device, an exposing device, a developing device and a transferring device.

According to the present invention, an excellent electrophotographic photosensitive member and a method for producing the same in which persistent relaxation of contact stress and suppression of potential variation in repeated use of an electrophotographic photosensitive member are both attained at a high level can be provided. Besides, a process cartridge and an electrophotographic apparatus including the electrophotographic photosensitive member can be provided.

Further features of the present invention will become apparent from the following description of exemplary embodiments with reference to the attached drawings.

DESCRIPTION OF THE EMBODIMENTS

Figure 1:
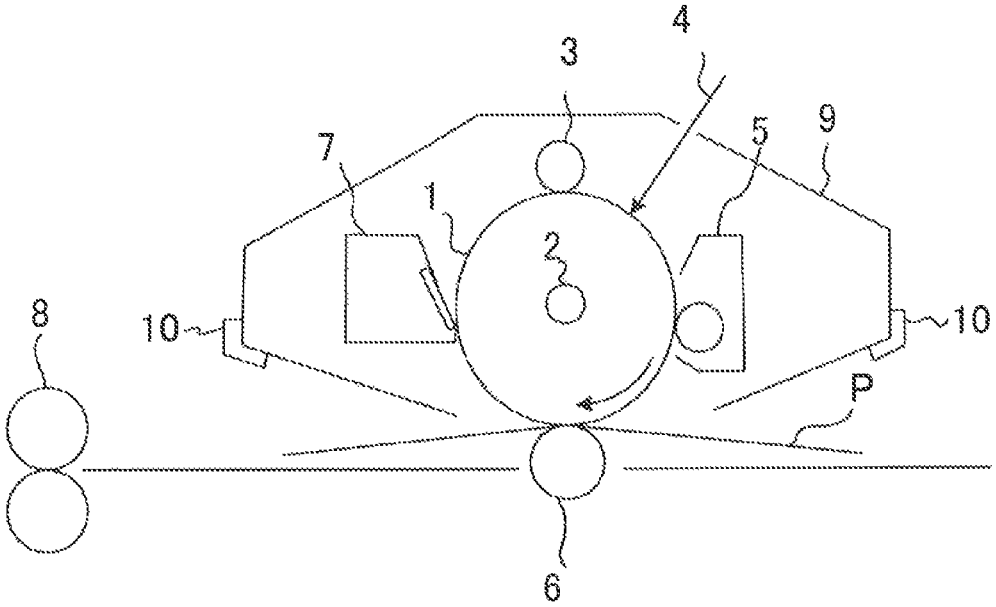
FIG. 1 is a diagram illustrating an example of the schematic structure of an electrophotographic apparatus provided with a process cartridge including an electrophotographic photosensitive member of the present invention.

Preferred embodiments of the present invention will now be described in detail in accordance with the accompanying drawings.

According to the present invention, a charge-transporting layer of an electrophotographic photosensitive member has a matrix-domain structure including the following matrix and the following domain.

The domain includes a silicone oil having a structural unit represented by the following formula (O-1), and at least one group selected from the group consisting of an alkyl group having 2 to 30 carbon atoms, a polyether group, an aralkyl group, an epoxy group, and an allyl group. The domain further includes at least one resin selected from the group consisting of: a resin A1 having a structural unit represented by the following formula (A-1) and a structural unit represented by the following formula (B); and a resin A2 having a structural unit represented by the following formula (A-2) and a structural unit represented by the following formula (B).

The matrix includes a resin C having a structural unit represented by the following formula (C), and a charge-transporting substance.

The content of the structural unit represented by the formula (A-1) and the structural unit represented by the formula (A-2) is from 10% by mass to 40% by mass based on the total mass of the resin A1 and the resin A2.

(A-1)

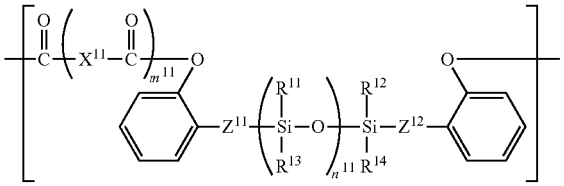

In the formula (A-1), $m^n$ represents 0 or 1; $X^{11}$ represents an ortho-phenylene group, a meta-phenylene group, a para-phenylene group, a bivalent group having two para-phenylene groups bonded with a methylene group, or a bivalent group having two para-phenylene groups bonded with an oxygen atom; $Z^{11}$ and $Z^{12}$ each independently represents an alkylene group having 1 to 4 carbon atoms; $R^{11}$ to $R^{14}$ each independently represents an alkyl group having 1 to 4 carbon atoms, or a phenyl group; $n^{11}$ represents the repetition number of a structure within brackets, and an average of $n^{11}$ in the resin A1 ranges from 20 to 150.

(A-2)

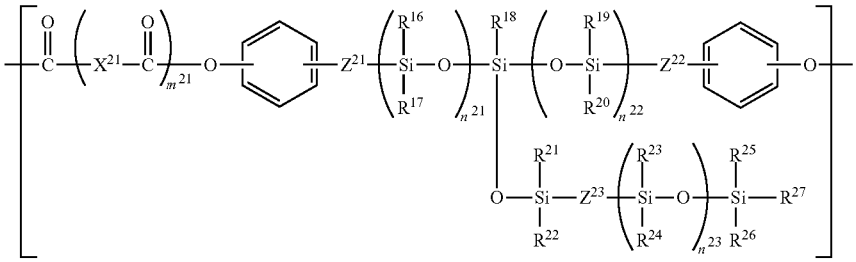

In the formula (A-2), $m^{21}$ represents 0 or 1; $X^{21}$ represents an ortho-phenylene group, a meta-phenylene group, a para-phenylene group, a bivalent group having two para-phenylene groups bonded with a methylene group, or a bivalent group having two para-phenylene groups bonded with an oxygen atom; $Z^{21}$ to $Z^{23}$ each independently represents an alkylene group having 1 to 4 carbon atoms; $R^{16}$ to $R^{27}$ each independently represents an alkyl group having 1 to 4 carbon atoms, or a phenyl group; $n^{21}$, $n^{22}$ and $n^{23}$ each independently represents the repetition number of a structure within brackets, an average of $n^{21}$ in the resin A2 ranges from 1 to 10, an average of $n^{22}$ in the resin A2 ranges from 1 to 10, and an average of $n^{23}$ in the resin A2 ranges from 20 to 200.

(B)

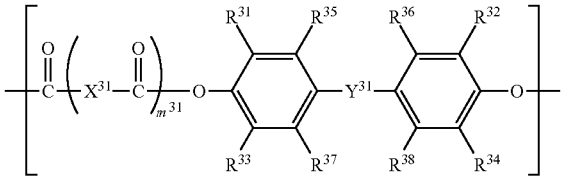

In the formula (B), $m^{31}$ represents 0 or 1; $X^{31}$ represents an ortho-phenylene group, a meta-phenylene group, a para-phenylene group, a bivalent group having two para-phenylene groups bonded with a methylene group, or a bivalent group having two para-phenylene groups bonded with an oxygen atom; $Y^{31}$ represents a single bond, a methylene group, an ethylidene group, a propylidene group, a cyclohexylidene group, a phenylmethylene group, a phenylethylidene group or an oxygen atom; and $R^{31}$ to $R^{38}$ each independently represents a hydrogen atom or a methyl group.

(C)

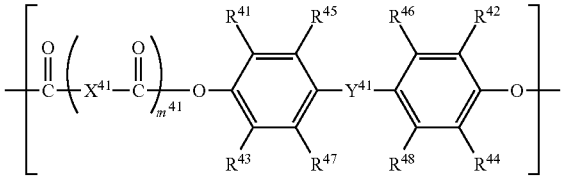

In the formula (C), $m^{41}$ represents 0 or 1; $X^{41}$ represents an ortho-phenylene group, a meta-phenylene group, a para-phenylene group, a bivalent group having two para-phenylene groups bonded with a methylene group, or a bivalent group having two para-phenylene groups bonded with an oxygen atom; $Y^{41}$ represents a single bond, a methylene group, an ethylidene group, a propylidene group, a cyclohexylidene group, a phenylmethylene group, a phenylethylidene group or an oxygen atom; and $R^{41}$ to $R^{48}$ each independently represents a hydrogen atom or a methyl group.

(O-1)

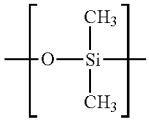

Since the silicone oil has a structural unit represented by the formula (O-1), and at least one group selected from the group consisting of an alkyl group having 2 to 30 carbon atoms, a polyether group, an aralkyl group, an epoxy group and an allyl group (hereinafter also referred to as the "specific substituent(s)"), the silicone oil is contained in the domain containing the resin A1, the resin A2. This is probably because the specific substituent of the silicone oil functions as an anchor unit so as to increase affinity with structures of the resin A1 and the resin A2 other than a Si portion, which probably causes the silicone oil to be easily entangled with molecular chains of the resin A1 and the resin A2. This is probably the reason why the silicone oil is contained in the domain containing the resin A1 and the resin A2.

The charge-transporting layer has the matrix-domain structure including a matrix containing the charge-transporting substance and the resin C, and domains formed in the matrix and containing the resin A1, the resin A2 and silicone oil. When the matrix-domain structure is compared to a "sea-island structure," the matrix corresponds to a sea part and the domain corresponds to an island part.

Each domain containing the resin A1, the resin A2 and the silicone oil has a granular (island) structure formed in the matrix containing the charge-transporting substance and the resin C. The domains each containing the resin A1, the resin A2 and the silicone oil are respectively spaced from one another to be independently present in the matrix. Such a matrix-domain structure can be verified by observing a surface of the charge-transporting layer or a cross-section of the charge-transporting layer.

The observation of the state of the matrix-domain structure or measurement of the domains can be performed by using, for example, a commercially available laser microscope, optical microscope, electron microscope or atomic force microscope. Any of these microscopes may be used with prescribed magnification for observing the state of the matrix-domain structure or measuring the structure of each domain.

The number average particle size of the domains can be from 100 nm to 3,000 nm. Furthermore, the size distribution of the particle sizes of the respective domains can be smaller from the viewpoint of uniformity in a coating film and a stress relaxation effect. For calculating the number average particle size, arbitrary 100 domains are selected from domains observed with a microscope in a vertical cross-section of the charge-transporting layer. The maximum diameters of the selected domains are measured, and the maximum diameters of the domains are averaged for calculating the number average particle size. Incidentally, when a cross-section of the charge-transporting layer is observed with a microscope, image information along the depth direction can be obtained, so as to acquire a three-dimensional image of the charge-transporting layer.

The matrix-domain structure of the charge-transporting layer can be formed as follows: A charge-transporting layer coating solution containing the charge-transporting substance, the resin A1, the resin A2, the silicone oil and the resin C is prepared for forming a coating film of the charge-transporting layer coating solution, and the coating film is dried, thereby forming the charge-transporting layer.

When the domains containing the resin A1, the resin A2 and the silicone oil are efficiently formed in the charge-transporting layer, persistent relaxation of the contact stress can be more effectively exhibited. Since the domains containing the resin A1, the resin A2 and the silicone oil are formed, localization of the silicone oil on an interface between the charge-transporting layer and the charge-generating layer can be suppressed, so that the potential variation occurring in repeated use of the electrophotographic photosensitive member can be suppressed. This is probably because a barrier to charge movement caused by localization of siloxane components on the interface between the charge-transporting layer and the charge-generating layer can be reduced, in the movement of charge from the charge-generating layer to the charge-transporting layer, by forming the aforementioned domains.

(Resin A1 and Resin A2)

Next, the resin A1 and the resin A2 will be described.

In the formula (A-1), $X^{11}$ may be a single group or two or more groups. $Z^{11}$ and $Z^{12}$ each represents an alkylene group having 1 to 4 carbon atoms, and specific examples include a methylene group, an ethylene group, a propylene group and a butylene group. From the viewpoint of the effect of relaxing the contact stress, $Z^{11}$ and $Z^{12}$ each can represent a propylene group. If $R^{11}$ to $R^{14}$ each represents an alkyl group having 1 to 4 carbon atoms, specific examples include a methyl group, an ethyl group, a propyl group and a butyl group. From the viewpoint of the effect of relaxing the contact stress, $R^{11}$ to $R^{14}$ each can represent a methyl group.

If the average of $n^{11}$ in the resin A1 ranges from 20 to 150, the domains containing the resin A1, the resin A2 and the silicone oil can be efficiently formed in the matrix containing the charge-transporting substance and the resin C. In particular, the average of $n^{11}$ can range from 40 to 80.

Examples of the structural unit represented by the formula (A-1) are shown in Table 1 below.

TABLE 1

| Formula (A-1) | m11 | X11 | R11-R14 | Z11, Z12 | n11 |
|---|---|---|---|---|---|
| A-1-1 | 1 | ortho-phenylene | methyl | propylene | 40 |
| A-1-2 | 1 | meta-phenylene | methyl | propylene | 40 |
| A-1-3 | 1 | para-phenylene | methyl | propylene | 40 |
| A-1-4 | 1 | 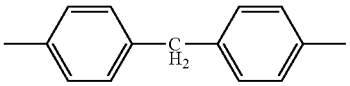 | methyl | propylene | 40 |

TABLE 1-continued

| Formula (A-1) | m11 | X11 | R11-R14 | Z11, Z12 | n11 |
|---|---|---|---|---|---|
| A-1-5 | 1 | 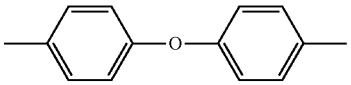 | methyl | propylene | 40 |
| A-1-6 | 1 | ortho-phenylene | methyl | propylene | 80 |
| A-1-7 | 1 | meta-phenylene | methyl | propylene | 80 |
| A-1-8 | 1 | para-phenylene | methyl | propylene | 80 |
| A-1-9 | 1 | 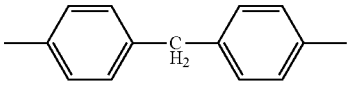 | ethyl | propylene | 80 |
| A-1-10 | 1 | 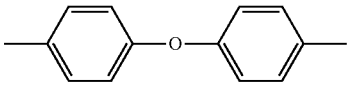 | methyl | propylene | 80 |
| A-1-11 | 1 | ortho-phenylene | butyl | methylene | 100 |
| A-1-12 | 1 | meta-phenylene | phenyl | ethylene | 150 |
| A-1-13 | 1 | para-phenylene | methyl | butylene | 20 |
| A-1-14 | 1 | para-phenylene | propyl | butylene | 120 |
| A-1-15 | 0 | — | methyl | propylene | 40 |
| A-1-16 | 0 | — | ethyl | propylene | 80 |
| A-1-17 | 0 | — | methyl | propylene | 60 |
| A-1-18 | 0 | — | butyl | methylene | 100 |
| A-1-19 | 0 | — | phenyl | ethylene | 150 |
| A-1-20 | 0 | — | methyl | butylene | 20 |
| A-1-21 | 0 | — | propyl | butylene | 120 |

In the formula (A-2), $X^{21}$ may be a single group or two or more groups. $Z^{21}$ to $Z^{23}$ each represents an alkylene group having 1 to 4 carbon atoms, and specific examples include a methylene group, an ethylene group, a propylene group and a butylene group. From the viewpoint of the effect of relaxing the contact stress, $Z^{21}$ and $Z^{22}$ can each represent a propylene group and $Z^{23}$ can represent an ethylene group. If $R^{16}$ to $R^{27}$ each represents an alkyl group having 1 to 4 carbon atoms, specific examples include a methyl group, an ethyl group, a propyl group and a butyl group. From the viewpoint of the effect of relaxing the contact stress, $R^{16}$ to $R^{27}$ can each represent a methyl group.

The average of $n^{21}$ in the resin A2 ranges from 1 to 10, the average of $n^{22}$ in the resin A2 ranges from 1 to 10, and the average of $n^{23}$ in the resin A2 ranges from 20 to 200. If these averages are within these ranges, the domains containing the resin A1, the resin A2 and the silicone oil can be efficiently formed in the matrix containing the charge-transporting substance and the resin C. The averages of $n^{21}$ and $n^{22}$ can range from 1 to 5, and the average of $n^{23}$ can range from 40 to 120. Examples of the structural unit represented by the formula (A-2) are shown in Table 2 below.

TABLE 2

| Formula (A-2) | m21 | X21 | R16-R27 | Z21, Z22 | Z23 | n21 | n22 | n23 |
|---|---|---|---|---|---|---|---|---|
| A-2-1 | 1 | ortho-phenylene | methyl | propylene | ethylene | 1 | 1 | 40 |
| A-2-2 | 1 | meta-phenylene | methyl | propylene | ethylene | 1 | 1 | 40 |
| A-2-3 | 1 | para-phenylene | methyl | propylene | ethylene | 1 | 1 | 40 |
| A-2-4 | 1 | 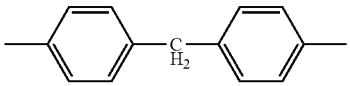 | methyl | propylene | ethylene | 1 | 1 | 40 |
| A-2-5 | 1 | 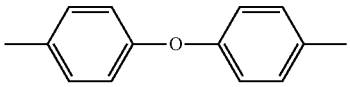 | methyl | propylene | ethylene | 1 | 1 | 40 |
| A-2-6 | 1 | ortho-phenylene | methyl | propylene | ethylene | 1 | 1 | 100 |
| A-2-7 | 1 | meta-phenylene | methyl | propylene | ethylene | 1 | 1 | 150 |
| A-2-8 | 1 | para-phenylene | methyl | propylene | ethylene | 1 | 1 | 200 |
| A-2-9 | 1 | 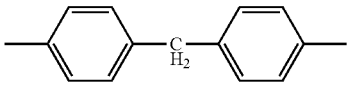 | ethyl | propylene | ethylene | 1 | 1 | 80 |

TABLE 2-continued

| Formula (A-2) | m21 | X21 | R16-R27 | Z21, Z22 | Z23 | n21 | n22 | n23 |
|---|---|---|---|---|---|---|---|---|
| A-2-10 | 1 | 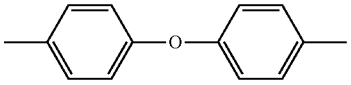 | methyl | propylene | ethylene | 1 | 1 | 80 |
| A-2-11 | 1 | ortho-phenylene | butyl | methylene | methylene | 5 | 5 | 40 |
| A-2-12 | 1 | meta-phenylene | phenyl | ethylene | methylene | 5 | 5 | 60 |
| A-2-13 | 1 | para-phenylene | methyl | butylene | butylene | 10 | 10 | 100 |
| A-2-14 | 1 | para-phenylene | propyl | butylene | ethylene | 10 | 10 | 20 |
| A-2-15 | 0 | — | methyl | propylene | ethylene | 1 | 1 | 40 |
| A-2-16 | 0 | — | ethyl | propylene | methylene | 1 | 1 | 40 |
| A-2-17 | 0 | — | methyl | propylene | ethylene | 1 | 1 | 40 |
| A-2-18 | 0 | — | butyl | methylene | methylene | 1 | 1 | 80 |
| A-2-19 | 0 | — | phenyl | ethylene | propylene | 5 | 5 | 60 |
| A-2-20 | 0 | — | methyl | butylene | propylene | 5 | 5 | 60 |
| A-2-21 | 0 | — | propyl | butylene | butylene | 10 | 10 | 120 |

Among those shown in Table 2, the structural units represented by the formulas (A-1-2), (A-1-3), (A-1-5), (A-1-10), (A-1-15), (A-1-17), (A-2-5), (A-2-10), (A-2-15), (A-2-16) and (A-2-17) can be suitably used.

Furthermore, each of the resin A1 and the resin A2 may have, as a terminal structure, a siloxane structure represented by the following formula (A-E):

(A-E)

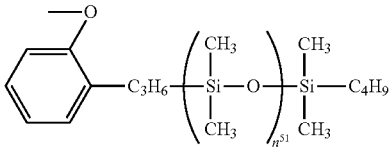

In the formula (A-E), $n^{51}$ represents the repetition number of a structure within brackets, and an average of $n^{51}$ in the resin A1 or the resin A2 ranges from 20 to 60.

In the formula (B), $X^{31}$ may be a single group or two or more groups.

Examples of the structural unit represented by the formula (B) are shown in Table 3 below.

TABLE 3

| Formula (B) | m31 | X31 | R31, R32 | R33, R34 | R35, R36 | R37, R38 | Y31 |
|---|---|---|---|---|---|---|---|
| B-1 | 1 | ortho-phenylene | methyl | H | H | H | propylidene |
| B-2 | 1 | meta-phenylene | methyl | H | H | H | propylidene |
| B-3 | 1 | para-phenylene | methyl | H | H | H | propylidene |
| B-4 | 1 | 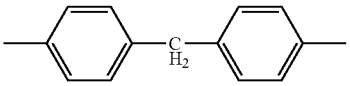 | methyl | H | H | H | propylidene |
| B-5 | 1 | 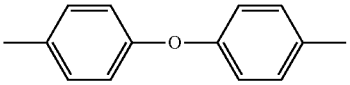 | methyl | H | H | H | propylidene |
| B-6 | 1 | para-phenylene | methyl | H | H | H | ethylidene |
| B-7 | 1 | para-phenylene | methyl | methyl | H | H | methylene |
| B-8 | 1 | para-phenylene | H | H | H | H | phenylmethylene |
| B-9 | 1 | 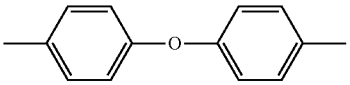 | H | H | H | H | single bond |

TABLE 3-continued

| Formula (B) | m31 | X31 | R31, R32 | R33, R34 | R35, R36 | R37, R38 | Y31 |
|---|---|---|---|---|---|---|---|
| B-10 | 1 | 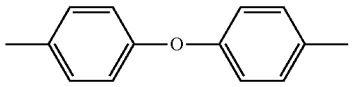 | methyl | H | H | H | ethylidene |
| B-11 | 1 | ortho-phenylene | methyl | methyl | H | H | single bond |
| B-12 | 1 | meta-phenylene | H | H | H | H | oxygen |
| B-13 | 1 | para-phenylene | H | H | H | H | phenylethylidene |
| B-14 | 1 | para-phenylene | H | H | H | H | propylidene |
| B-15 | 1 | para-phenylene | H | H | H | H | cyclohexylidene |
| B-16 | 0 | — | methyl | H | H | H | propylidene |
| B-17 | 0 | — | methyl | H | H | H | ethylidene |
| B-18 | 0 | — | methyl | methyl | H | H | methylene |
| B-19 | 0 | — | H | H | H | H | phenylmethylene |
| B-20 | 0 | — | H | H | H | H | single bond |
| B-21 | 0 | — | methyl | H | H | H | single bond |
| B-22 | 0 | — | methyl | methyl | H | H | single bond |
| B-23 | 0 | — | H | H | H | H | oxygen |
| B-24 | 0 | — | H | H | H | H | phenylethylidene |
| B-25 | 0 | — | H | H | H | H | propylidene |
| B-26 | 0 | — | H | H | H | H | cyclohexylidene |

In Table 3, "propylidene" indicates a 2,2-propylidene group and "phenylethylidene" indicates a 1-phenyl-1,1-ethylidene group.

Furthermore, the content of the structural unit represented by the formula (A-1) and the structural unit represented by the formula (A-2) is from 10% by mass to 40% by mass based on the total mass of the resin A1 and the resin A2. Specifically, if the resin A1 is contained but the resin A2 is not contained, {the mass of the structural unit represented by the formula (A-1)}/(the mass of the resin A1) is from 10% by mass to 40% by mass. Alternatively, if the resin A2 is contained but the resin A1 is not contained, {the mass of the structural unit represented by the formula (A-2)}/(the mass of the resin A2) is from 10% by mass to 40% by mass. If both the resin A1 and the resin A2 are contained, {the mass of the structural unit represented by the formula (A-1)+the mass of the structural unit represented by the formula (A-2)}/(the mass of the resin A1+the mass of the resin A2) is from 10% by mass to 40% by mass. Furthermore, the content of the structural unit represented by the formula (B) is from 60% by mass to 90% by mass based on the total mass of the resin A1 and the resin A2. Specifically, if the resin A1 is contained but the resin A2 is not contained, {the mass of the structural unit represented by the formula (B)}/(the mass of the resin A1) is from 60% by mass to 90% by mass. Alternatively, if the resin A2 is contained but the resin A1 is not contained, {the mass of the structural unit represented by the formula (B)}/(the mass of the resin A2) is from 60% by mass to 90% by mass. If both the resin A1 and the resin A2 are contained, {the mass of the structural unit represented by the formula (B)}/(the mass of the resin A1+the mass of the resin A2) is from 60% by mass to 90% by mass.

If the content of the structural unit represented by the formula (A-1) and the structural unit represented by the formula (A-2) is from 10% by mass to 40% by mass, the domains can be efficiently formed in the matrix containing the charge-transporting substance and the resin C. Therefore, the effect of relaxing the contact stress can be persistently exhibited. Furthermore, localization of the resin A1 and the resin A2 on the interface between the charge-transporting layer and the charge-generating layer can be suppressed, so as to suppress the potential variation.

Moreover, from the viewpoint of efficiently forming the domains in the matrix, the total content of the resin A1 and the resin A2 is preferably from 5% by mass to 50% by mass based on the total mass of all resins contained in the charge-transporting layer. The total content is more preferably from 10% by mass to 40% by mass.

Furthermore, as long as the effects of the present invention are not retarded, the resin A1 and the resin A2 may contain a bisphenol-derived structural unit as a structural unit apart from the structural unit represented by the formula (A-1), the structural unit represented by the formula (A-2) and the structural unit represented by the formula (B). In this case, the content of the bisphenol-derived structural unit can be 30% by mass or less based on the total mass of the resin A1 and the resin A2.

The resin A1 is a copolymer having the structural unit represented by the formula (A-1) and the structural unit represented by the formula (B). The resin A2 is a copolymer having the structural unit represented by the formula (A-2) and the structural unit represented by the formula (B). The form of copolymerization of these resins may be any one of block copolymerization, random copolymerization, alternating copolymerization and the like.

The weight average molecular weight of the resin A1 and the resin A2 is preferably from 30,000 to 200,000 from the viewpoint of forming the domains in the matrix containing the charge-transporting substance and the resin C. The weight average molecular weight is more preferably from 40,000 to 150,000.

In the present invention, the weight average molecular weight of a resin means a weight average molecular weight in terms of polystyrene measured by a usual method, specifically, a method described in Japanese Patent Application Laid-Open No. 2007-79555.

The copolymerization ratio of the resin A1 and the copolymerization ratio of the resin A2 can be verified, as generally carried out, by a conversion method using a peak area ratio of a hydrogen atom (a hydrogen atom contained in the resins) obtained by measuring the $^{1}$H-NMR of the resins.

The resin A1 and the resin A2 used in the present invention can be synthesized by a method described in International Publication No. WO2010/008095.

(Resin C)

The resin C having the structural unit represented by the formula (C) will now be described. In the formula (C), $X^{41}$ may be a single group or two or more groups. $Y^{41}$ can be a propylidene group. $Y^{41}$ is preferably a 2-2-propylidene group.

Examples of the structural unit represented by the formula (C) are shown in Table 4 below.

TABLE 4

| Formula (C) | m41 | X41 | R41, R42 | R43, R44 | R45, R46 | R47, R48 | Y41 |
|---|---|---|---|---|---|---|---|
| C-1 | 1 | ortho-phenylene | methyl | H | H | H | propylidene |
| C-2 | 1 | meta-phenylene | methyl | H | H | H | propylidene |
| C-3 | 1 | para-phenylene | methyl | H | H | H | propylidene |
| C-4 | 1 | 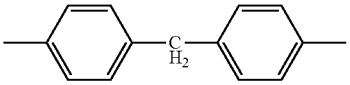 | methyl | H | H | H | propylidene |
| C-5 | 1 | 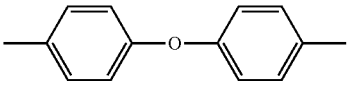 | methyl | H | H | H | propylidene |
| C-6 | 1 | para-phenylene | methyl | H | H | H | ethylidene |
| C-7 | 1 | para-phenylene | methyl | methyl | H | H | methylene |
| C-8 | 1 | para-phenylene | H | H | H | H | phenylmethylene |
| C-9 | 1 | 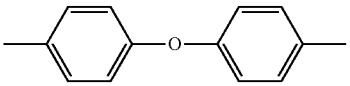 | H | H | H | H | single bond |
| C-10 | 1 | 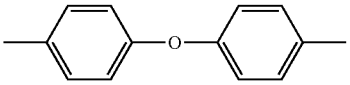 | methyl | H | H | H | ethylidene |
| C-11 | 1 | ortho-phenylene | methyl | methyl | H | H | single bond |
| C-12 | 1 | meta-phenylene | H | H | H | H | oxygen |
| C-13 | 1 | para-phenylene | H | H | H | H | phenylethylidene |
| C-14 | 1 | para-phenylene | H | H | H | H | propylidene |
| C-15 | 1 | para-phenylene | H | H | H | H | cyclohexylidene |
| C-16 | 0 | — | methyl | H | H | H | propylidene |
| C-17 | 0 | — | methyl | H | H | H | ethylidene |
| C-18 | 0 | — | methyl | methyl | H | H | methylene |
| C-19 | 0 | — | H | H | H | H | phenylmethylene |
| C-20 | 0 | — | H | H | H | H | single bond |
| C-21 | 0 | — | methyl | H | H | H | single bond |
| C-22 | 0 | — | methyl | methyl | H | H | single bond |
| C-23 | 0 | — | H | H | H | H | oxygen |
| C-24 | 0 | — | H | H | H | H | phenylethylidene |
| C-25 | 0 | — | H | H | H | H | propylidene |
| C-26 | 0 | — | H | H | H | H | cyclohexylidene |

In Table 4, "propylidene" means a 2,2-propylidene group and "phenylethylidene" means a 1-phenyl-1,1-ethylidene group.

Among those shown in Table 4, the structural units represented by any one of the formulas (C-2), (C-3), (C-4), (C-5), (C-10), (C-16), (C-18), (C-19), (C-24), (C-25) and (C-26) can be suitably used.

(Silicone Oil)

Next, the silicone oil will be described.

Examples of the alkyl group having 2 to 30 carbon atoms include: an ethyl group, an n-propyl group, an isopropyl group, an n-butyl group, an isobutyl group, a sec-butyl group, a tert-butyl group, an n-pentyl group, an isopentyl group, a neopentyl group, a tert-pentyl group, an n-hexyl group, an isohexyl group, a 2-ethylhexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a heneicosyl group, a docosyl group, a tricosyl group, a tetracosyl group, a pentacosyl group, a hexacosyl group, a heptacosyl group, an octacosyl group, a nonacosyl group and a triacontyl group. An alkyl group having 3 to 25 carbon atoms can be more suitably used.

The polyether group is an alkylene group bonded to an oxygen atom (—O—: ether bond). In particular, a polyether group having a structure represented by $(C_2H_4O)_a(C_3H_6O)_b$ can be suitably used, where a and b each represents the repetition number of a structure within brackets, and each independently ranges from 3 to 350.

Examples of the aralkyl group include a benzyl group, a 1-phenylethyl group, a 2-phenylethyl group, a 2-methyl-2-phenylethyl group, a 1-phenylisopropyl group, a 2-phenylisopropyl group and a phenyl-tert-butyl group. Among these, a 1-phenylethyl group, a 2-phenylethyl group, a 2-methyl-2-phenylethyl group, a 1-phenylisopropyl group and a 2-phenylisopropyl group can be suitably used.

Examples of the epoxy group include a 3,4-epoxybutyl group, a 7,8-epoxyoctyl group, a 9,10-epoxydecyl group, a glycidyloxypropyl group and a 2-(3,4-epoxycyclohexyl) ethyl group.

The silicone oil may have merely one of or a plurality of these specific substituents.

Furthermore, the silicone oil may have a structure represented by the following formula (O-E) as a terminal structure.

(O-E)

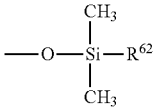

In the formula (O-E), $R^{62}$ represents a methyl group, a methacrylic group, a 3-(meth)acryloxymethyl group, 3-(meth)acryloxyethyl group, a 3-(meth)acryloxypropyl group, a 3-(meth)acryloxybutyl group, a 3-(meth)acryloxypentyl group, a 3-(meth)acryloxyhexyl group, a 3,4-epoxybutyl group, a 7,8-epoxyoctyl group, a 9,10-epoxydecyl group, a glycidyloxypropyl group, a 2-(3,4-epoxycyclohexyl)ethyl group or a polystyrene group.

The polystyrene group is represented by the following formula, where 1 represents the repetition number of a structure within brackets, and an average of 1 in the silicone oil ranges from 10 to 300.

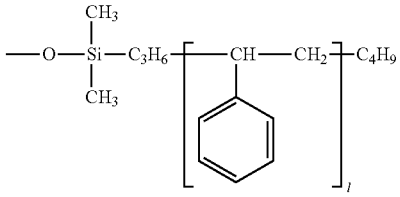

The viscosity of the silicone oil is preferably from 10 to 5,000 $mm^2/s$. Examples of the silicone oil (sometimes referred to as the "Si oil") are shown in Table 5 below. Incidentally, each of silicone oils D-1 to D-56 mentioned below has the structural unit represented by the formula (O-1).

TABLE 5

| Si oil | Specific substituent(s) | R62 of terminal structure |
|---|---|---|
| D-1 | 3,4-epoxybutyl | methyl |
| D-2 | 7,8-epoxyoctyl | methyl |
| D-3 | 9,10-epoxydecyl | methyl |
| D-4 | glycidyloxypropyl | methyl |
| D-5 | 2-(3,4-epoxycyclohexyl)ethyl | methyl |
| D-6 | 3,4-epoxybutyl/2-methyl-2-phenylethyl | methyl |
| D-7 | 7,8-epoxyoctyl/2-methyl-2-phenylethyl | methyl |
| D-8 | 9,10-epoxydecyl/2-methyl-2-phenylethyl | methyl |
| D-9 | glycidyloxypropyl/2-methyl-2-phenylethyl | methyl |
| D-10 | 2-(3,4-epoxycyclohexyl)ethyl/2-methyl-2-phenylethyl | methyl |
| D-11 | 3,4-epoxybutyl | 3,4-epoxybutyl |
| D-12 | 7,8-epoxyoctyl | 7,8-epoxyoctyl |
| D-13 | 9,10-epoxydecyl | 9,10-epoxydecyl |
| D-14 | glycidyloxypropyl | glycidyloxypropyl |
| D-15 | 2-(3,4-epoxycyclohexyl)ethyl | 2-(3,4-epoxycyclohexyl)ethyl |
| D-16 | glycidyloxypropyl | 3,4-epoxybutyl |
| D-17 | glycidyloxypropyl | 7,8-epoxyoctyl |
| D-18 | glycidyloxypropyl | 9,10-epoxydecyl |
| D-19 | glycidyloxypropyl | glycidyloxypropyl |
| D-20 | glycidyloxypropyl | 2-(3,4-epoxycyclohexyl)ethyl |
| D-21 | 2-(3,4-epoxycyclohexyl)ethyl | 3,4-epoxybutyl |
| D-22 | 2-(3,4-epoxycyclohexyl)ethyl | 7,8-epoxyoctyl |
| D-23 | 2-(3,4-epoxycyclohexyl)ethyl | 9,10-epoxydecyl |
| D-24 | 2-(3,4-epoxycyclohexyl)ethyl | glycidyloxypropyl |
| D-25 | 2-(3,4-epoxycyclohexyl)ethyl | 2-(3,4-epoxycyclohexyl)ethyl |
| D-26 | methyl | methacrylic |
| D-27 | methyl | 3-(meth)acryloxymethyl |
| D-28 | methyl | 4-(meth)acryloxyethyl |
| D-29 | methyl | 3-(meth)acryloxypropyl |
| D-30 | methyl | 3-(meth)acryloxybutyl |
| D-31 | methyl | 3-(meth)acryloxypentyl |
| D-32 | methyl | 3-(meth)acryloxyhexyl |
| D-33 | n-butyl | methyl |
| D-34 | isopentyl | methyl |
| D-35 | n-hexyl | methyl |
| D-36 | 2-ethylhexyl | methyl |
| D-37 | heptyl | methyl |
| D-38 | octyl | methyl |
| D-39 | nonyl | methyl |
| D-40 | decyl | methyl |
| D-41 | undecyl | methyl |
| D-42 | dodecyl | methyl |
| D-43 | pentadecyl | methyl |
| D-44 | octadecyl | methyl |
| D-45 | eicosyl | methyl |
| D-46 | $(C_2H_4O)_3(C_3H_6O)_3$ | methyl |
| D-47 | $(C_2H_4O)_5(C_3H_6O)_8$ | methyl |
| D-48 | $(C_2H_4O)_6(C_3H_6O)_{10}$ | methyl |
| D-49 | $(C_2H_4O)_{50}(C_3H_6O)_{20}$ | methyl |
| D-50 | $(C_2H_4O)_{50}(C_3H_6O)_{200}$ | methyl |
| D-51 | $(C_2H_4O)_{20}(C_3H_6O)_{180}$ | methyl |
| D-52 | $(C_2H_4O)_{150}(C_3H_6O)_{120}$ | methyl |
| D-53 | $(C_2H_4O)_3(C_3H_6O)_3$/nonyl/2-methyl-2-phenylethyl | methyl |
| D-54 | $(C_2H_4O)_5(C_3H_6O)_8$/dodecyl/2-methyl-2-phenylethyl | methyl |

TABLE 5-continued

| Si oil | Specific substituent(s) | R62 of terminal structure |
|---|---|---|
| D-55 | $(C_2H_4O)_6(C_3H_6O)_{10}$/octyl/2-methyl-2-phenylethyl | methyl |
| D-56 | methyl | polystyrene |

The silicone oil is commercially available as modified silicone compounds specifically as follows:

- Silicone oil having a structural unit represented by the formula (O-1) and an epoxy group: KF101 and X-22-9002 (manufactured by Shin-Etsu Chemical Co., Ltd.)
- Silicone oil having a structural unit represented by the formula (O-1), and an epoxy group and an aralkyl group: X-22-3000T (manufactured by Shin-Etsu Chemical Co., Ltd.)
- Silicone oil having a structural unit represented by the formula (O-1) and an allyl group: X-22-164B (manufactured by Shin-Etsu Chemical Co., Ltd.)
- Silicone oil having a structural unit represented by the formula (O-1) and an alkyl group having 2 to 30 carbon atoms: KF414 (manufactured by Shin-Etsu Chemical Co., Ltd.)
- Silicone oil having a structural unit represented by the formula (O-1) and a polyether group: KF945 (manufactured by Shin-Etsu Chemical Co., Ltd.)
- Silicone oil having a structural unit represented by the formula (O-1), and an alkyl group having 2 to 30 carbon atoms, a polyether group and an aralkyl group: X-22-2516 (manufactured by Shin-Etsu Chemical Co., Ltd.).

Alternatively, the silicone oils shown in Table 5 can be synthesized by synthesis methods described in Japanese Patent Application Laid-Open Nos. H02-88639, H03-234768, H04-168126 and H04-169589. Also in the present invention, silicone oil (hereinafter sometimes referred to as the "Si oil") was synthesized by a similar method using raw materials corresponding to substituents shown in Table 5. The compositions and the viscosities of the synthesized silicone oils are shown in Table 6.

TABLE 6

| Synthesis example | Si oil | Content (wt %) of substituent | Viscosity ($mm^2/s$) |
|---|---|---|---|
| Synthesis example 1 | D-4 | 1.2 | 1500 |
| Synthesis example 2 | D-9 | 0.7 | 2500 |
| Synthesis example 3 | D-19 | 20 | 900 |
| Synthesis example 4 | D-29 | 47 | 55 |
| Synthesis example 5 | D-33 | 10 | 100 |
| Synthesis example 6 | D-38 | 20 | 120 |
| Synthesis example 7 | D-42 | 30 | 130 |
| Synthesis example 8 | D-45 | 40 | 110 |
| Synthesis example 9 | D-48 | 20 | 120 |
| Synthesis example 10 | D-51 | 30 | 130 |
| Synthesis example 11 | D-54 | 30 | 70 |

Furthermore, the silicone oils D-56-1, D-56-2 and D-56-3 can be synthesized by a method described in Japanese Patent Application Laid-Open No. 2010-66669. These silicone oils are specifically compounds having the following structures:

(D-56-1)

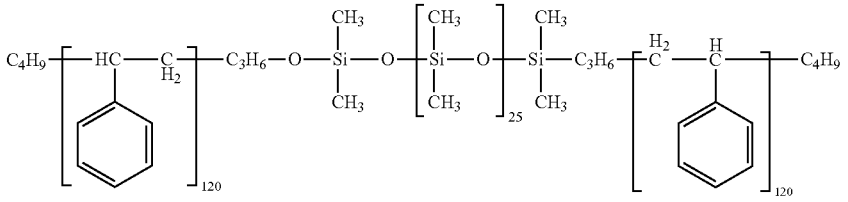

(D-56-2)

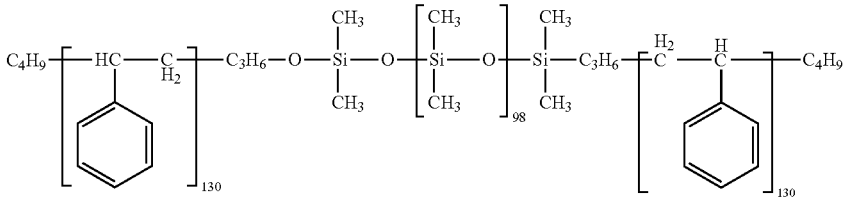

(D-56-3)

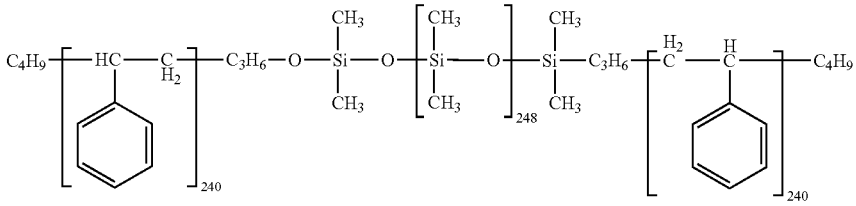

The content of the silicone oil is preferably from 1% by mass to 50% by mass based on the total mass of the resin A1 and the resin A2 because the silicone oil can be thus efficiently contained in the domain containing the resin A1 and the resin A2.

Furthermore, from the viewpoint of suppressing the potential variation in repeated use, the content of the silicone oil can be from 0.1% by mass to 20% by mass based on the total mass of all resins contained in the charge-transporting layer.

The charge-transporting layer of the present invention has the matrix-domain structure including the matrix containing the charge-transporting substance and the resin C, and the domains formed in the matrix and formed by the silicone oil and at least one of the resin A1 and the resin A2.

Now, synthesis examples of the resin A1 and the resin A2 will be described.

The resin A1 and the resin A2 can be synthesized by a synthesis method described in International Publication No. WO2010/008095. Also in the present invention, resins A1 and resins A2 as shown as synthesis examples in Table 7 were synthesized by a similar method by using raw materials corresponding to the structural unit represented by the formula (A-1), the structural unit represented by the formula (A-2) and the structural unit represented by the formula (B). The compositions and the weight average molecular weights of the synthesized resins A1 and A2 are shown in Table 7. Incidentally, the resin A1 and the resin A2 may be generically designated as the "resin A."

TABLE 7

| Synthesis example | Resin A | Formula (A-1) or (A-2) | Formula (B) | $n^{51}$ in Formula (A-E) | Content (mass %) of Formula (A-1) or (A-2) | Content (mass %) of Formula (6) | Content (mass %) of Formula (A-E) | Mw |
|---|---|---|---|---|---|---|---|---|
| 1 | Resin A(1) | A-1-5 | B-5 | — | 20 | 80 | — | 90000 |
| 2 | Resin A(2) | A-1-5 | B-5 | — | 10 | 90 | — | 100000 |
| 3 | Resin A(3) | A-1-5 | B-5 | — | 30 | 70 | — | 120000 |
| 4 | Resin A(4) | A-1-5 | B-5 | — | 40 | 60 | — | 110000 |
| 5 | Resin A(5) | A-1-5 | B-5 | — | 15 | 85 | — | 130000 |
| 6 | Resin A(6) | A-1-5 | B-5 | — | 25 | 75 | — | 80000 |
| 7 | Resin A(7) | A-1-2/A-1-3 = 5/5 | B-2/B-3 = 5/5 | — | 20 | 80 | — | 90000 |
| 8 | Resin A(8) | A-1-2/A-1-5 = 3/7 | B-2/B-5 = 3/7 | — | 30 | 70 | — | 100000 |
| 9 | Resin A(9) | A-1-3/A-1-5 = 1/9 | B-3/B-5 = 1/9 | — | 25 | 75 | — | 120000 |
| 10 | Resin A(10) | A-1-2/A-1-5 = 7/3 | B-3/B-10 = 7/3 | — | 15 | 85 | — | 110000 |
| 11 | Resin A(11) | A-1-2/A-1-5 = 6/4 | B-3/B-10 = 6/4 | — | 10 | 90 | — | 130000 |
| 12 | Resin A(12) | A-1-10 | B-5 | — | 20 | 80 | — | 80000 |
| 13 | Resin A(13) | A-1-10 | B-5 | — | 10 | 90 | — | 100000 |
| 14 | Resin A(14) | A-1-10 | B-5 | — | 30 | 70 | — | 120000 |
| 15 | Resin A(15) | A-1-10 | B-5 | — | 40 | 60 | — | 110000 |
| 16 | Resin A(16) | A-1-15 | B-23/B-26 = 2/8 | — | 20 | 80 | — | 90000 |
| 17 | Resin A(17) | A-1-15 | B-23/B-26 = 2/8 | — | 25 | 75 | — | 100000 |
| 18 | Resin A(18) | A-1-15 | B-23/B-26 = 2/8 | — | 30 | 70 | — | 80000 |
| 19 | Resin A(19) | A-1-15 | B-23/B-26 = 1/9 | — | 40 | 60 | — | 70000 |
| 20 | Resin A(20) | A-1-15 | B-23/B-26 = 2/8 | 40 | 10 | 80 | 10 | 100000 |
| 21 | Resin A(21) | A-1-15 | B-23/B-26 = 2/8 | 40 | 20 | 70 | 10 | 60000 |
| 22 | Resin A(22) | A-1-15 | B-23/B-26 = 2/8 | 40 | 10 | 70 | 20 | 50000 |
| 23 | Resin A(23) | A-1-15 | B-23/B-26 = 2/8 | 40 | 30 | 60 | 10 | 40000 |
| 24 | Resin A(24) | A-1-17 | B-23/B-26 = 2/8 | 40 | 10 | 60 | 30 | 30000 |
| 25 | Resin A(25) | A-2-5 | B-16 | — | 10 | 90 | — | 80000 |
| 26 | Resin A(26) | A-2-15 | B-26 | — | 20 | 80 | — | 100000 |
| 27 | Resin A(27) | A-2-15 | B-16/B-26 = 7/3 | — | 20 | 80 | — | 90000 |
| 28 | Resin A(28) | A-2-20 | B-16/B-24 = 7/3 | — | 30 | 70 | — | 70000 |
| 29 | Resin A(29) | A-2-15 | B-16 | 40 | 10 | 80 | 10 | 60000 |
| 30 | Resin A(30) | A-2-16 | B-17 | 60 | 10 | 80 | 10 | 50000 |
| 31 | Resin A(31) | A-2-17 | B-18 | 20 | 10 | 80 | 10 | 70000 |

In table 7, "Formula (A-1) or (A-2)" means a structural unit represented by the formula (A-1) contained in each resin A1 or a structural unit represented by the formula (A-2) contained in each resin A2. If a plurality of structural units represented by the formula (A-1) or a plurality of structural units represented by the formula (A-2) are mixedly used, the types of the structural units and a mixing ratio (in a mole ratio) are shown. "Formula (B)" means a structural unit represented by the formula (B) contained in each resin A1 or A2. If a plurality of structural units represented by the formula (B) are mixedly used, the types of the structural units and a mixing ratio (in a mole ratio) are shown. Besides, "$n^{51}$ in Formula (A-E)" means an average of the repetition number in a structural unit represented by the formula (A-E) contained in each resin A1 or A2. "Content (mass %) of Formula (A-1) or (A-2)" means the content (% by mass) of a structural unit represented by the formula (A-1) in each resin A1 or the content (% by mass) of a structural unit represented by the formula (A-2) in each resin A2. "Content (mass %) of Formula (B)" means the content (% by mass) of a structural unit represented by the formula (B) in each resin A1 or A2. "Content (mass %) of Formula (A-E)" means the content (% by mass) of a structural unit represented by the formula (A-E) in each resin A1 or A2. "Mw" means the weight average molecular weight of each resin A1 or A2.

The charge-transporting layer corresponding to the surface layer of the electrophotographic photosensitive member contains at least one of the resin A1 and the resin A2, and the resin C, and another resin may be mixedly used. Examples of another resin that may be mixedly used include an acrylic resin, a polyester resin and a polycarbonate resin.

Furthermore, from the viewpoint of efficiently forming the matrix-domain structure, it is preferable that the resin C contains neither a structural unit represented by the formula (A-1) nor a structural unit represented by the formula (A-2).

The charge-transporting layer contains the charge-transporting substance. Examples of the charge-transporting substance include a triarylamine compound, a hydrazone compound, butadiene compound and an enamine compound. One of these charge-transporting substances may be singly used, or two or more of these may be used together. Among these compounds, a triarylamine compound can be suitably used as the charge-transporting substance from the viewpoint of improvement of electrophotographic characteristics.

Specific examples of the charge-transporting substance are as follows:

(E-1)

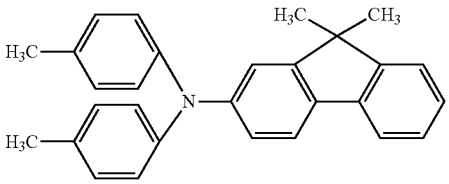

(E-2)

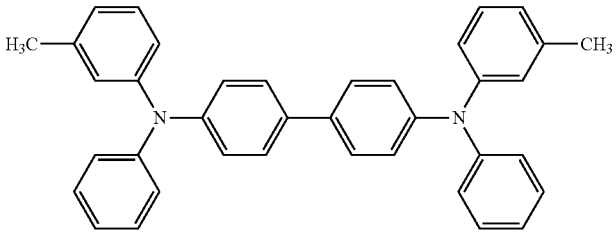

(E-3)

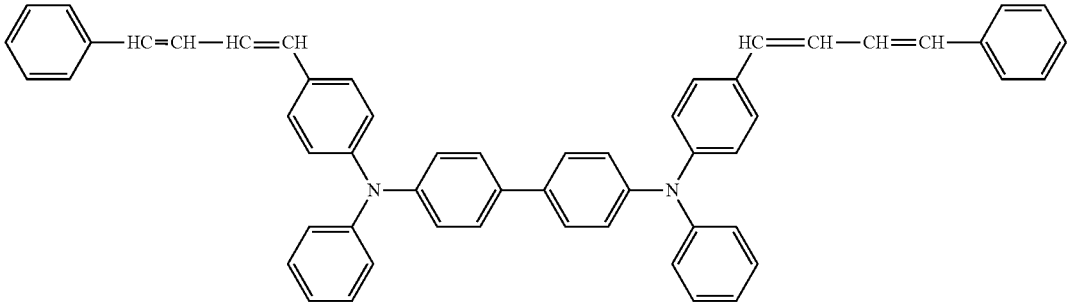

(E-4)

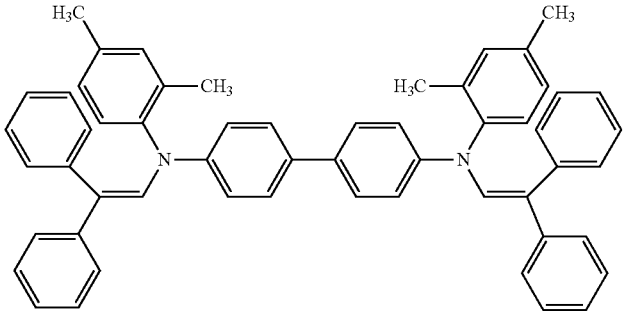

The ratio between the charge-transporting substance and the resins is preferably 4:10 to 20:10 (in a mass ratio) and more preferably 5:10 to 12:10 (in a mass ratio). Furthermore, the content of the charge-transporting substance can be from 25% by mass to 70% by mass based on the total mass of the charge-transporting layer.

Examples of a solvent to be used in the charge-transporting layer coating solution include a ketone solvent, an ester solvent, an ether solvent and an aromatic hydrocarbon solvent. One of these solvents may be singly used, or a mixture of two or more of these may be used. Among these solvents, an ether solvent or an aromatic hydrocarbon solvent can be suitably used from the viewpoint of resin solubility.

The thickness of the charge-transporting layer is preferably from 5 μm to 50 μm, and more preferably from 10 μm to 35 μm.

Besides, an antioxidant, a UV absorber, a plasticizer or the like may be added to the charge-transporting layer as occasion demands.

The charge-transporting layer can be formed from a coating film of the charge-transporting layer coating solution, which is prepared by dissolving, in the solvent, at least one selected from the group consisting of the resin A1 and the resin A2, the silicone oil, the charge-transporting substance and the resin C.

Next, the structure of the electrophotographic photosensitive member of the present invention will be described.

The electrophotographic photosensitive member includes a support, a charge-generating layer formed on the support and a charge-transporting layer formed on the charge-generating layer. Furthermore, the charge-transporting layer is a surface layer (an uppermost layer) of the electrophotographic photosensitive member. Moreover, the charge-transporting layer may have a layered structure, and in that case, at least a surfacemost(outermost) portion of the charge-transporting layer has the matrix-domain structure.

As for the shape of the electrophotographic photosensitive member, a cylindrical electrophotographic photosensitive member obtained by forming a photosensitive layer (a charge-generating layer and a charge-transporting layer) on a cylindrical support is generally widely used, but the electrophotographic photosensitive member can be in the shape of a belt, a sheet or the like.

Figure 2A:
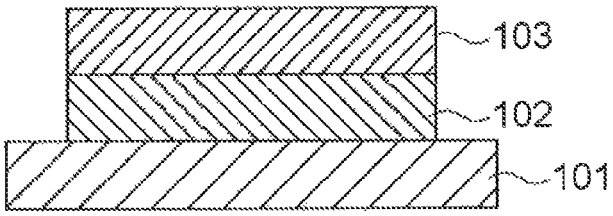
FIGS. 2A and 2B are diagrams illustrating examples of a layered structure of an electrophotographic photosensitive member.
Figure 2B:
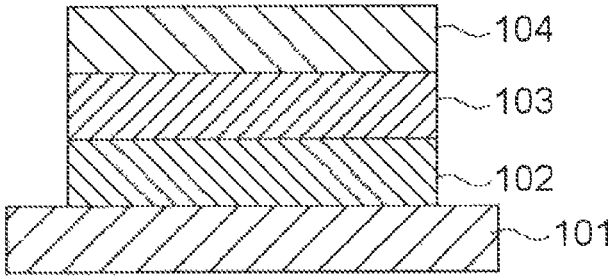

FIGS. 2A and 2B are diagrams illustrating examples of a layered structure of the electrophotographic photosensitive member of the present invention. In FIGS. 2A and 2B, a reference numeral 101 denotes a support, a reference numeral 102 denotes a charge-generating layer, a reference numeral 103 denotes a charge-transporting layer (or a first charge-transporting layer) and a reference numeral 104 denotes a second charge-transporting layer.

(Support)

The support can be one having conductivity (namely, a conductive support), and a support made of a metal such as aluminum, an aluminum alloy or stainless steel can be used. As a support made of aluminum or an aluminum alloy, an ED tube, an EI tube, or a support obtained by subjecting such a tube to cutting, electrolytic composite polishing, or wet or dry honing can be used. Alternatively, a metal support or a resin support on which a film of aluminum, an aluminum alloy or an indium oxide-tin oxide alloy is formed by vacuum deposition can be used. The surface of the support may be subjected to cutting, surface roughening, an alumite treatment or the like.

Further alternatively, a support obtained by impregnating a resin or the like with conductive particles such as carbon black, tin oxide particles, titanium oxide particles or silver particles, or a plastic support containing a conductive resin can be used.

A conductive layer may be provided between the support and an undercoat layer described later or the charge-generating layer for purposes of suppressing interference fringe derived from scattering of laser beams or the like and covering a scar of the support. This conductive layer is formed by using a conductive layer coating solution obtained by dispersing conductive particles in a resin.

Examples of the conductive particles include carbon black, acetylene black, a metal powder of aluminum, nickel, iron, nichrome, copper, zinc, silver or the like, and a metal oxide powder of conductive tin oxide or ITO.

Examples of the resin used for the conductive layer include a polyester resin, a polycarbonate resin, a polyvinyl butyral resin, an acrylic resin, a silicone resin, an epoxy resin, a melamine resin, a urethane resin, a phenol resin and an alkyd resin.

Examples of a solvent used in the conductive layer coating solution include an ether solvent, an alcohol solvent, a ketone solvent and an aromatic hydrocarbon solvent.

The thickness of the conductive layer is preferably from 0.2 μm to 40 μm, more preferably from 1 μm to 35 μm and further preferably from 5 μm to 30 μm.

Between the support or the conductive layer and the charge-generating layer, an undercoat layer may be provided.

The undercoat layer can be formed by forming a coating film by applying, on the conductive layer, an undercoat layer coating solution containing a resin, and drying or curing the coating film.

Examples of the resin used for the undercoat layer include polyacrylic acids, methyl cellulose, ethyl cellulose, a polyamide resin, a polyimide resin, a polyamideimide resin, a polyamic acid resin, a melamine resin, an epoxy resin, a polyurethane resin and a polyolefin resin. The resin for the undercoat layer can be a thermoplastic resin. Specifically, a thermoplastic polyamide resin or polyolefin resin can be suitably used. As the polyamide resin, low-crystalline or non-crystalline copolymer nylon that can be applied in a solution state can be suitably used. The polyolefin resin can be in a state usable as a particle dispersion. Besides, the polyolefin resin can be dispersed in an aqueous medium.

The thickness of the undercoat layer is preferably from 0.05 μm to 7 μm and more preferably from 0.1 μm to 2 μm.

Furthermore, the undercoat layer may contain semiconductive particles, an electron transporting substance or an electron accepting substance.

(Charge-Generating Layer)

The charge-generating layer is provided on the support, the conductive layer or the undercoat layer.

Examples of a charge-generating substance used in the electrophotographic photosensitive member of the present invention include an azo pigment, a phthalocyanine pigment, an indigo pigment and a perylene pigment. One of these charge-generating substances may be singly used, or two or more of these may be used together. Among these substances, metal phthalocyanines such as oxytitanium phthalocyanine, hydroxygallium phthalocyanine and chlorogallium phthalocyanine can be particularly suitably used because of their high sensitivity.

Examples of a resin used for the charge-generating layer include a polycarbonate resin, a polyester resin, a butyral resin, a polyvinyl acetal resin, an acrylic resin, a vinyl acetate resin and a urea resin. Among these resins, a butyral resin can be particularly suitably used. One of these resins may be singly used, or one, two or more of these may be used in the form of a mixture or a copolymer.

The charge-generating layer can be formed by forming a coating film of a charge-generating layer coating solution obtained by dispersing a charge-generating substance with a resin and a solvent, and drying the thus obtained coating film. Alternatively, the charge-generating layer may be formed as a deposited film of a charge-generating substance.

As a dispersing method, a method using, for example, a homogenizer, ultrasonic waves, a ball mill, a sand mill, an attritor or a roll mill can be employed.

The ratio between the charge-generating substance and the resin is preferably 1:10 to 10:1 (in a mass ratio) and particularly more preferably 1:1 to 3:1 (in a mass ratio).

Examples of the solvent used in the charge-generating layer coating solution include an alcohol solvent, a sulfoxide solvent, a ketone solvent, an ether solvent, an ester solvent and an aromatic hydrocarbon solvent.

The thickness of the charge-generating layer is preferably 5 μm or less and more preferably from 0.1 μm to 2 μm.

Furthermore, various agents such as a sensitizing agent, an antioxidant, a UV absorber and a plasticizer may be added to the charge-generating layer as occasion demands. Moreover, the charge-generating layer may contain an electron transporting substance or an electron accepting substance, so as not to stagnate the flow of charge in the charge-generating layer.

The charge-transporting layer is provided on the charge-generating layer.

Various additives may be added to each layer of the electrophotographic photosensitive member. Examples of the additives include an antidegradant such as an antioxidant, a UV absorber or a light stabilizer, and fine particles such as organic fine particles or inorganic fine particles. Examples of the antidegradant include a hindered phenol antioxidant, a hindered amine light stabilizer, a sulfur atom-containing antioxidant and a phosphorus atom-containing antioxidant. Examples of the organic fine particles include polymer resin particles such as fluorine atom-containing resin particles, polystyrene fine particles and polyethylene resin particles. Examples of the inorganic fine particles include fine particles of metal oxides such as silica and alumina.

In applying the coating solution for each layer, an application method such as a dip applying method (a dip-coating method), a spray coating method, a spinner coating method, a roller coating method, a Meyer bar coating method or a blade coating method can be employed.

Furthermore, the surface of the charge-transporting layer, that is, the surface layer of the electrophotographic photosensitive member, may be provided with irregularities (recesses and protrusions). The irregularities can be formed by any of known methods. Examples of the method for forming the irregularities include the following: A method in which recesses are formed by blasting abrasive particles against the surface; a method in which irregularities are formed by bringing a mold having an irregular surface into contact with the surface with a pressure; a method in which recesses are formed by forming dew on a surface of the coating film of an applied surface layer coating solution and then drying the dew; and a method in which recesses are formed by irradiating the surface with laser beams. Among these methods, the method in which irregularities are formed by bringing a mold having an irregular surface into contact with the surface of the electrophotographic photosensitive member with a pressure can be suitably employed. Alternatively, the method in which recesses are formed by forming dew on a surface of the coating film of an applied surface layer coating solution and then drying the dew can be suitably employed.

(Electrophotographic Apparatus)

FIG. 1 illustrates an example of the schematic structure of an electrophotographic apparatus provided with a process cartridge including an electrophotographic photosensitive member of the present invention.

In FIG. 1, a reference numeral 1 denotes a cylindrical electrophotographic photosensitive member, which is driven to rotate around an axis 2 in a direction illustrated with an arrow at a prescribed circumferential speed. The surface of the electrophotographic photosensitive member 1 thus driven to rotate is uniformly charged to a positive or negative prescribed potential by charging device 3 (primary charging device, such as a charging roller). Subsequently, the electrophotographic photosensitive member 1 is irradiated with exposing light 4 (image exposing light) output from exposing device (not shown) for slit exposure, laser beam scanning exposure or the like. In this manner, an electrostatically latent image corresponding to a desired image is successively formed on the surface of the electrophotographic photosensitive member 1.

The electrostatically latent image formed on the surface of the electrophotographic photosensitive member 1 is developed into a toner image by a toner contained in a developer supplied by developing device 5. Subsequently, the toner image formed and carried on the surface of the electrophotographic photosensitive member 1 is successively transferred onto a transfer material P (such as paper) by a transfer bias applied by transferring device 6 (such as a transfer roller). Incidentally, the transfer material P is taken out of transfer material supplying device (not shown) in synchronization with the rotation of the electrophotographic photosensitive member 1 to be fed to a portion (a contact portion) between the electrophotographic photosensitive member 1 and the transferring device 6.

The transfer material P onto which the toner image has been transferred is separated from the surface of the electrophotographic photosensitive member 1 to be introduced into fixing device 8, in which the image is fixed, and thus, the resultant is output as an image formed product (a printed or copied product) to the outside of the apparatus.

After transferring the toner image, the surface of the electrophotographic photosensitive member 1 is cleaned by cleaning device 7 (such as a cleaning blade) so as to remove remaining developer (toner). Subsequently, the electrophotographic photosensitive member is subjected to a discharging treatment with pre-exposing light (not shown) emitted by pre-exposing device (not shown), so as to be repeatedly used for image formation. Incidentally, if the charging device 3 is contact charging device using a charging roller or the like as illustrated in FIG. 1, pre-exposure is not always necessary.

Among the components such as the electrophotographic photosensitive member 1, the charging device 3, the developing device 5, the transferring device 6 and the cleaning device 7, some are housed in a vessel to be integrated as a process cartridge. This process cartridge may be constructed to be removably provided in a main body of an electrophotographic apparatus such as a copying machine or a laser beam printer. In FIG. 1, the electrophotographic photosensitive member 1, the charging device 3, the developing device 5 and the cleaning device 7 are integrally supported as a cartridge, so as to provide a process cartridge 9 that may be removably provided in a main body of an electrophotographic apparatus by using guiding device 10 such as a rail provided on the main body of the electrophotographic apparatus.

EXAMPLES

The present invention will now be described in more detail with reference to specific examples. In the following examples, the term "part(s)" means "part(s) by mass."

Example 1

An aluminum cylinder having a diameter of 24 mm and a length of 257 mm was used as a support (a conductive support).

Next, a conductive layer coating solution was prepared by using 10 parts of $SnO_2$-coated barium sulfate particles (used as conductive particles), 2 parts of titanium oxide particles (used as a pigment for adjusting resistance), 6 parts of a phenol resin, 0.001 part of silicone oil (used as a leveling agent) and a mixed solvent of 4 parts of methanol and 16 parts of methoxypropanol. The conductive layer coating solution was dip-coated on the support to obtain a coating film, and the coating film was cured (thermally cured) at 140° C. for 30 minutes, thereby forming a conductive layer with a thickness of 15 μm.

Next, an undercoat layer coating solution was prepared by dissolving 3 parts of N-methoxymethylated nylon and 3 parts of copolymer nylon in a mixed solvent of 65 parts of methanol and 30 parts of n-butanol. The undercoat layer coating solution was dip-coated on the conductive layer to form a coating film, and the coating film was dried at 100° C. for 10 minutes, thereby forming an undercoat layer with a thickness of 0.7 μm.

Next, 10 parts of hydroxygallium phthalocyanine (having intensive peaks, in CuKα characteristic X-ray diffraction, at the Bragg angle 2θ±0.2° of 7.5°, 9.9°, 16.3°, 18.6°, 25.1° and 28.3°) was added, as a charge-generating substance, to a solution of 5 parts of a polyvinyl butyral resin (trade name: S-lec BX-1, manufactured by Sekisui Chemical Co., Ltd.)

dissolved in 250 parts of cyclohexanone. The resulting solution was subjected to dispersion by using a sand mill apparatus using glass beads with a diameter of 1 mm in an atmosphere of 23±3° C. for 1 hour. After the dispersion, 250 parts of ethyl acetate was added to the resulting solution, thereby preparing a charge-generating layer coating solution. The charge-generating layer coating solution was dip-coated on the undercoat layer to form a coating film, and the coating film was dried at 100° C. for 10 minutes, thereby forming a charge-generating layer with a thickness of 0.26 μm.

Next, a charge-transporting layer coating solution was prepared by dissolving, in a mixed solvent of 30 parts of dimethoxymethane and 50 parts of ortho-xylene, 6.4 parts of a compound represented by the formula (E−1) (used as a charge-transporting substance), 0.8 part of a compound represented by the formula (E-2) (used as a charge-transporting substance), 3 parts of the resin A(1) synthesized as Synthesis Example 1, 7 parts of a resin C (having a weight average molecular weight of 120,000) containing a structural unit represented by the formula (C-2) and a structural unit represented by the formula (C-3) in a mole ratio of 5:5, and 0.03 part of a silicone oil (KF414, manufactured by Shin-Etsu Chemical Co., Ltd.).

This charge-transporting layer coating solution was dip-coated on the charge-generating layer to form a coating film, and the coating film was dried at 120° C. for 1 hour, thereby forming a charge-transporting layer with a thickness of 16 μm. The thus formed charge-transporting layer was verified to have domains that contain the resin A(1) and the silicone oil and are formed in a matrix containing the charge-transporting substances and the resin C.

In this manner, the electrophotographic photosensitive member having the charge-transporting layer as a surface layer was produced. The compositions of the silicone oil and the resins contained in the charge-transporting layer are shown in Table 8.

Next, evaluation will be described.

The evaluation was made on variation in a potential of a light portion (potential variation) caused in repeated use for making 5,000 copies, relative values of torque obtained at an initial stage and after the repeated use for making 5,000 copies, and observation of the surface of the electrophotographic photosensitive member in measuring the torque.

<Evaluation of Potential Variation>

As an evaluation apparatus, a laser beam printer, Color Laser JET CP4525dn manufactured by Hewlett-Packard was used. The evaluation was performed under environment of a temperature of 23° C. and relative humidity of 50%. Exposure (image exposure) of a laser source of 780 nm of the evaluation apparatus was set so that light quantity of 0.37 μJ/cm$^2$ could be attained on the surface of the electrophotographic photosensitive member. Surface potentials (a dark portion potential and a light portion potential) of the electrophotographic photosensitive member were measured in a position of a developing device with the developing device replaced with a jig fixed to have a potential measuring probe in a position away by 130 mm from the end of the electrophotographic photosensitive member. With the dark portion potential of an unexposed portion of the electrophotographic photosensitive member set to −500 V, laser beams were irradiated for measuring a light portion potential resulting from light attenuation from the dark portion potential. Furthermore, A4-size regular paper was used for continuously outputting 5,000 copies, and variation in the light portion potential caused through this continuous operation was evaluated. A test chart having a printing ratio of 5% was used. The result is shown in a column of "Potential variation" of Table 12.

<Evaluation of Torque Relative Value>

A driving current value (a current value A) of a rotary motor for the electrophotographic photosensitive member was measured under the same conditions as those employed for the evaluation of the potential variation. This is evaluation of the quantity of contact stress caused between the electrophotographic photosensitive member and a cleaning blade. The magnitude of the obtained current value corresponds to the magnitude of the quantity of contact stress caused between the electrophotographic photosensitive member and the cleaning blade.

Furthermore, an electrophotographic photosensitive member to be used as a control in measuring a torque relative value was produced as follows: The resin A(1) used as the resin for the charge-transporting layer of the electrophotographic photosensitive member of Example 1 was replaced with a resin C containing a structural unit represented by the formula (C-2) and a structural unit represented by the formula (C-3) in a mole ratio of 5:5. An electrophotographic photosensitive member was produced in the same manner as in Example 1 except that the silicone oil (KF414) was not used and the resin C alone was used as the resin, and the resultant was used as a control electrophotographic photosensitive member.

The thus produced control electrophotographic photosensitive member was used for measuring a driving current value (a current value B) of a rotary motor for the electrophotographic photosensitive member in the same manner as in Example 1.

The ratio between the driving current value (the current value A) of the rotary motor for the electrophotographic photosensitive member containing the resin A1 or the resin A2 and the driving current value (the current value B) of the rotary motor for the electrophotographic photosensitive member not containing the resin A1 and the resin A2 thus measured was calculated. The calculated value of (the current value A)/(the current value B) was compared as a torque relative value. This torque relative value corresponds to the degree of reduction of the quantity of the contact stress caused between the electrophotographic photosensitive member and the cleaning blade, and as the torque relative value is smaller, the degree of the reduction of the quantity of the contact stress caused between the electrophotographic photosensitive member and the cleaning blade is larger. The result is shown in a column of "Initial torque relative value" of Table 12.

Subsequently, A4-size regular paper was used for continuously outputting 5,000 copies. A test chart with a printing ratio of 5% was used. Thereafter, a torque relative value attained after the repeated use for making 5,000 copies was measured. The torque relative value attained after the repeated use for making 5,000 copies was measured in the same manner as the initial torque relative value. In this case, the control electrophotographic photosensitive member was also used for repeatedly outputting 5,000 copies, and a driving current value of the rotary motor obtained in the repeated use was used for calculating a torque relative value attained after the repeated use for making 5,000 copies. The result is shown in a column of "Torque relative value after making 5000 copies" of Table 12.

<Evaluation of Matrix-Domain Structure>

In the electrophotographic photosensitive member produced as described above, a cross-section of the charge-transporting layer obtained by vertically cutting the charge-transporting layer was observed with an ultradeep profile measuring microscope VK-9500 (manufactured by Keyence Corporation). In the observation, the magnification of an objective lens was set to 50×, an area of 100 μm square (10,000 μm$^2$) on the surface of the electrophotographic photosensitive member was observed as an observation field of view, and maximum diameters of 100 domains formed in and randomly selected in the observation field of view were measured. An average was calculated as a number average particle size based on the obtained maximum diameters. The result is shown in Table 12.

Examples 2 to 44

Electrophotographic photosensitive members were produced in the same manner as in Example 1 except that a silicone oil was changed as shown in Table 8, and the produced electrophotographic photosensitive members were evaluated in the same manner as in Example 1. It was verified, in the charge-transporting layer of each of the electrophotographic photosensitive members, that domains containing the resin A1 and the silicone oil were formed in a matrix containing the charge-transporting substance and the resin C. The results are shown in Table 12.

Incidentally, the weight average molecular weight of the resin C was:

(C-2)/(C-3)=5/5 (in a mole ratio): 120,000.

Examples 45 to 53

Electrophotographic photosensitive members were produced in the same manner as in Example 1 except that a resin C used in the charge-transporting layer was changed as shown in Table 8 and Table 9, and the produced electrophotographic photosensitive members were evaluated in the same manner as in Example 1. It was verified, in the charge-transporting layer of each of the electrophotographic photosensitive members, that domains containing the resin A1 and the silicone oil were formed in a matrix containing the charge-transporting substance and the resin C. The results are shown in Table 12 and Table 13.

Incidentally, the weight average molecular weights of the resins C were as follows:

(C-10): 100,000;

(C-5): 110,000;

(C-2)/(C-5)=3/7 (in a mole ratio): 110,000;

(C-2)/(C-10)=7/3 (in a mole ratio): 120,000;

(C-16): 140,000;

(C-19): 160,000;

(C-24): 130,000;

(C-25): 140,000; and (C-26): 130,000.

Examples 54 to 144

Electrophotographic photosensitive members were produced in the same manner as in Example 1 except that a resin A1, a resin C and a silicone oil were changed as shown in Table 9 and Table 10, and the produced electrophotographic photosensitive members were evaluated in the same manner as in Example 1. It was verified, in the charge-transporting layer of each of the electrophotographic photosensitive members, that domains containing the resin A1 and the silicone oil were formed in a matrix containing the charge-transporting substance and the resin C. The results are shown in Table 13 and Table 14.

Incidentally, the weight average molecular weights of the resins C were as follows:

(C-4): 100,000; and (C-18): 140,000.

Comparative Example 1

An electrophotographic photosensitive member was produced in the same manner as in Example 1 except that the resin A(1) and the silicone oil (KF414) were not used but a resin C containing a structural unit represented by the formula (C-2) and a structural unit represented by the formula (C-3) in a mole ratio of 5:5 was used instead. Since the charge-transporting layer of this electrophotographic photosensitive member does not contain a resin A1, a resin A2 and a silicone oil, a matrix-domain structure was not found in the charge-transporting layer. The electrophotographic photosensitive member was evaluated in the same manner as in Example 1. The result is shown in Table 15.

Comparative Examples 2 to 29

Electrophotographic photosensitive members were produced in the same manner as in Comparative Example 1 except that a resin C and a silicone oil were changed as shown in Table 11. Since the charge-transporting layer of each of these electrophotographic photosensitive members does not contain the resin A1 and the resin A2, a matrix-domain structure was not found in the charge-transporting layer. The electrophotographic photosensitive members were evaluated in the same manner as in Example 1. The results are shown in Table 15.

Comparative Example 30

An electrophotographic photosensitive member was produced in the same manner as in Example 1 except that the silicone oil was replaced with dimethylpolysiloxane (KF96, manufactured by Shin-Etsu Chemical Co., Ltd.). It was verified that domains were formed in a matrix. The electrophotographic photosensitive member was evaluated in the same manner as in Example 1. The result is shown in Table 15. Incidentally, dimethylpolysiloxane is a compound that has a structural unit represented by the formula (O-1) but has none of the specific substituents such as an alkyl group having 2 to 30 carbon atoms, a polyether group, an aralkyl group, an epoxy group and an allyl group.

Comparative Examples 31 to 35

Electrophotographic photosensitive members were produced in the same manner as in Comparative Example 30 except that the resin A1, the resin C and the contents of the silicone oil of Comparative Example 30 were changed as shown in Table 11. It was verified in each of these electrophotographic photosensitive members that domains were formed in a matrix. The electrophotographic photosensitive members were evaluated in the same manner as in Example 1. The results are shown in Table 15.

TABLE 8

| Example | Resin A | Resin C | Resin A/resin C mixing ratio | Silicone oil | Mass % of Silicone oil to resin A |
|---|---|---|---|---|---|
| 1 | Resin A(1) | C-2/C-3 = 5/5 | 3/7 | KF414 | 1 |
| 2 | Resin A(1) | C-2/C-3 = 5/5 | 3/7 | KF414 | 10 |
| 3 | Resin A(1) | C-2/C-3 = 5/5 | 3/7 | KF414 | 30 |
| 4 | Resin A(1) | C-2/C-3 = 5/5 | 3/7 | KF414 | 50 |
| 5 | Resin A(1) | C-2/C-3 = 5/5 | 3/7 | KF101 | 1 |
| 6 | Resin A(1) | C-2/C-3 = 5/5 | 3/7 | KF101 | 50 |
| 7 | Resin A(1) | C-2/C-3 = 5/5 | 3/7 | X-22-3000T | 1 |
| 8 | Resin A(1) | C-2/C-3 = 5/5 | 3/7 | X-22-3000T | 50 |
| 9 | Resin A(1) | C-2/C-3 = 5/5 | 3/7 | X-22-9002 | 1 |
| 10 | Resin A(1) | C-2/C-3 = 5/5 | 3/7 | X-22-9002 | 50 |
| 11 | Resin A(1) | C-2/C-3 = 5/5 | 3/7 | X-22-164B | 1 |
| 12 | Resin A(1) | C-2/C-3 = 5/5 | 3/7 | X-22-164B | 50 |
| 13 | Resin A(1) | C-2/C-3 = 5/5 | 3/7 | KF945 | 1 |
| 14 | Resin A(1) | C-2/C-3 = 5/5 | 3/7 | KF945 | 50 |
| 15 | Resin A(1) | C-2/C-3 = 5/5 | 3/7 | X-22-2516 | 1 |
| 16 | Resin A(1) | C-2/C-3 = 5/5 | 3/7 | X-22-2516 | 50 |
| 17 | Resin A(1) | C-2/C-3 = 5/5 | 3/7 | D-56-1 | 1 |
| 18 | Resin A(1) | C-2/C-3 = 5/5 | 3/7 | D-56-1 | 50 |
| 19 | Resin A(1) | C-2/C-3 = 5/5 | 3/7 | D-56-2 | 1 |
| 20 | Resin A(1) | C-2/C-3 = 5/5 | 3/7 | D-56-2 | 50 |
| 21 | Resin A(1) | C-2/C-3 = 5/5 | 3/7 | D-56-3 | 1 |
| 22 | Resin A(1) | C-2/C-3 = 5/5 | 3/7 | D-56-3 | 50 |
| 23 | Resin A(1) | C-2/C-3 = 5/5 | 3/7 | D-4 | 1 |
| 24 | Resin A(1) | C-2/C-3 = 5/5 | 3/7 | D-4 | 50 |
| 25 | Resin A(1) | C-2/C-3 = 5/5 | 3/7 | D-9 | 1 |
| 26 | Resin A(1) | C-2/C-3 = 5/5 | 3/7 | D-9 | 50 |
| 27 | Resin A(1) | C-2/C-3 = 5/5 | 3/7 | D-19 | 1 |
| 28 | Resin A(1) | C-2/C-3 = 5/5 | 3/7 | D-19 | 50 |
| 29 | Resin A(1) | C-2/C-3 = 5/5 | 3/7 | D-29 | 1 |
| 30 | Resin A(1) | C-2/C-3 = 5/5 | 3/7 | D-29 | 50 |
| 31 | Resin A(1) | C-2/C-3 = 5/5 | 3/7 | D-33 | 1 |
| 32 | Resin A(1) | C-2/C-3 = 5/5 | 3/7 | D-33 | 50 |
| 33 | Resin A(1) | C-2/C-3 = 5/5 | 3/7 | D-38 | 1 |
| 34 | Resin A(1) | C-2/C-3 = 5/5 | 3/7 | D-38 | 50 |
| 35 | Resin A(1) | C-2/C-3 = 5/5 | 3/7 | D-42 | 1 |
| 36 | Resin A(1) | C-2/C-3 = 5/5 | 3/7 | D-42 | 50 |
| 37 | Resin A(1) | C-2/C-3 = 5/5 | 3/7 | D-45 | 1 |
| 38 | Resin A(1) | C-2/C-3 = 5/5 | 3/7 | D-45 | 50 |
| 39 | Resin A(1) | C-2/C-3 = 5/5 | 3/7 | D-48 | 1 |
| 40 | Resin A(1) | C-2/C-3 = 5/5 | 3/7 | D-48 | 50 |
| 41 | Resin A(1) | C-2/C-3 = 5/5 | 3/7 | D-51 | 1 |
| 42 | Resin A(1) | C-2/C-3 = 5/5 | 3/7 | D-51 | 50 |
| 43 | Resin A(1) | C-2/C-3 = 5/5 | 3/7 | D-54 | 1 |
| 44 | Resin A(1) | C-2/C-3 = 5/5 | 3/7 | D-54 | 50 |
| 45 | Resin A(1) | C-10 | 3/7 | KF414 | 10 |
| 46 | Resin A(1) | C-5 | 3/7 | KF414 | 30 |
| 47 | Resin A(1) | C-2/C-5 = 3/7 | 3/7 | KF414 | 10 |
| 48 | Resin A(1) | C-2/C-10 = 7/3 | 3/7 | KF414 | 30 |
| 49 | Resin A(1) | C-16 | 3/7 | KF414 | 10 |
| 50 | Resin A(1) | C-19 | 3/7 | KF414 | 30 |

TABLE 9

| Example | Resin A | Resin C | Resin A/resin C mixing ratio | Silicone oil | Mass % of Silicone oil to resin A |
|---|---|---|---|---|---|
| 51 | Resin A(1) | C-24 | 3/7 | KF414 | 10 |
| 52 | Resin A(1) | C-25 | 3/7 | KF414 | 30 |
| 53 | Resin A(1) | C-26 | 3/7 | KF414 | 30 |
| 54 | Resin A(2) | C-2/C-3 = 5/5 | 4/6 | KF414 | 30 |
| 55 | Resin A(3) | C-10 | 2/8 | X-22-3000T | 10 |
| 56 | Resin A(4) | C-4 | 1/9 | X-22-9002 | 10 |
| 57 | Resin A(5) | C-2/C-5 = 3/7 | 3/7 | X-22-164B | 10 |
| 58 | Resin A(6) | C-2/C-10 = 7/3 | 3/7 | D-56-2 | 10 |
| 59 | Resin A(7) | C-18 | 3/7 | KF414 | 10 |
| 60 | Resin A(8) | C-19 | 3/7 | X-22-3000T | 10 |
| 61 | Resin A(9) | C-24 | 3/7 | X-22-9002 | 10 |
| 62 | Resin A(10) | C-25 | 3/7 | X-22-164B | 10 |
| 63 | Resin A(11) | C-26 | 3/7 | D-56-2 | 10 |
| 64 | Resin A(12) | C-2/C-3 = 5/5 | 3/7 | KF414 | 30 |
| 65 | Resin A(12) | C-2/C-3 = 5/5 | 3/7 | X-22-3000T | 30 |
| 66 | Resin A(12) | C-2/C-3 = 5/5 | 3/7 | X-22-9002 | 30 |

TABLE 9-continued

| Example | Resin A | Resin C | Resin A/resin C mixing ratio | Silicone oil | Mass % of Silicone oil to resin A |
|---|---|---|---|---|---|
| 67 | Resin A(12) | C-2/C-3 = 5/5 | 3/7 | X-22-164B | 30 |
| 68 | Resin A(12) | C-2/C-3 = 5/5 | 3/7 | D-56-2 | 30 |
| 69 | Resin A(12) | C-26 | 3/7 | KF414 | 10 |
| 70 | Resin A(13) | C-16 | 3/7 | X-22-3000T | 10 |
| 71 | Resin A(14) | C-19 | 3/7 | X-22-9002 | 10 |
| 72 | Resin A(15) | C-24 | 3/7 | X-22-164B | 10 |
| 73 | Resin A(16) | C-26 | 3/7 | KF414 | 1 |
| 74 | Resin A(16) | C-26 | 3/7 | KF414 | 10 |
| 75 | Resin A(16) | C-26 | 3/7 | KF414 | 30 |
| 76 | Resin A(16) | C-26 | 3/7 | KF414 | 50 |
| 77 | Resin A(16) | C-26 | 3/7 | KF101 | 1 |
| 78 | Resin A(16) | C-26 | 3/7 | KF101 | 50 |
| 79 | Resin A(16) | C-16 | 3/7 | X-22-3000T | 1 |
| 80 | Resin A(16) | C-19 | 3/7 | X-22-3000T | 50 |
| 81 | Resin A(16) | C-24 | 3/7 | X-22-9002 | 1 |
| 82 | Resin A(16) | C-25 | 3/7 | X-22-9002 | 50 |
| 83 | Resin A(16) | C-16 | 3/7 | X-22-164B | 1 |
| 84 | Resin A(16) | C-19 | 3/7 | X-22-164B | 50 |
| 85 | Resin A(16) | C-24 | 3/7 | KF945 | 1 |
| 86 | Resin A(16) | C-25 | 3/7 | KF945 | 50 |
| 87 | Resin A(16) | C-26 | 3/7 | D-4 | 1 |
| 88 | Resin A(16) | C-26 | 3/7 | D-4 | 50 |
| 89 | Resin A(16) | C-26 | 3/7 | D-9 | 1 |
| 90 | Resin A(16) | C-26 | 3/7 | D-9 | 50 |
| 91 | Resin A(16) | C-26 | 3/7 | D-19 | 1 |
| 92 | Resin A(16) | C-26 | 3/7 | D-19 | 50 |
| 93 | Resin A(16) | C-26 | 3/7 | D-29 | 1 |
| 94 | Resin A(16) | C-26 | 3/7 | D-29 | 50 |
| 95 | Resin A(16) | C-26 | 3/7 | D-33 | 1 |
| 96 | Resin A(16) | C-26 | 3/7 | D-33 | 50 |
| 97 | Resin A(16) | C-26 | 3/7 | D-38 | 1 |
| 98 | Resin A(16) | C-26 | 3/7 | D-38 | 50 |
| 99 | Resin A(16) | C-26 | 3/7 | D-42 | 1 |
| 100 | Resin A(16) | C-26 | 3/7 | D-42 | 50 |

TABLE 10

| Example | Resin A | Resin C | Resin A/resin C mixing ratio | Silicone oil | Mass % of Silicone oil to resin A |
|---|---|---|---|---|---|
| 101 | Resin A(16) | C-26 | 3/7 | D-45 | 1 |
| 102 | Resin A(16) | C-26 | 3/7 | D-45 | 50 |
| 103 | Resin A(16) | C-26 | 3/7 | D-48 | 1 |
| 104 | Resin A(16) | C-26 | 3/7 | D-48 | 50 |
| 105 | Resin A(16) | C-26 | 3/7 | D-51 | 1 |
| 106 | Resin A(16) | C-26 | 3/7 | D-51 | 50 |
| 107 | Resin A(16) | C-26 | 3/7 | D-54 | 1 |
| 108 | Resin A(16) | C-26 | 3/7 | D-54 | 50 |
| 109 | Resin A(16) | C-2/C-3 = 5/5 | 3/7 | X-22-2516 | 1 |
| 110 | Resin A(16) | C-10 | 3/7 | X-22-2516 | 50 |
| 111 | Resin A(16) | C-5 | 3/7 | D-56-1 | 1 |
| 112 | Resin A(16) | C-2/C-5 = 3/7 | 3/7 | D-56-1 | 50 |
| 113 | Resin A(16) | C-2/C-10 = 7/3 | 3/7 | D-56-2 | 1 |
| 114 | Resin A(16) | C-26 | 4/6 | D-56-2 | 50 |
| 115 | Resin A(16) | C-26 | 2/8 | D-56-3 | 1 |
| 116 | Resin A(16) | C-26 | 1/9 | D-56-3 | 50 |
| 117 | Resin A(16) | C-26 | 3/7 | D-56-3 | 10 |
| 118 | Resin A(17) | C-26 | 3/7 | X-22-3000T | 30 |
| 119 | Resin A(18) | C-26 | 3/7 | X-22-9002 | 10 |
| 120 | Resin A(19) | C-26 | 3/7 | X-22-164B | 30 |
| 121 | Resin A(20) | C-26 | 3/7 | KF414 | 30 |
| 122 | Resin A(20) | C-26 | 3/7 | KF414 | 10 |
| 123 | Resin A(20) | C-26 | 3/7 | KF414 | 30 |
| 124 | Resin A(20) | C-16 | 3/7 | KF414 | 10 |
| 125 | Resin A(20) | C-19 | 3/7 | KF414 | 30 |
| 126 | Resin A(20) | C-24 | 3/7 | KF414 | 10 |
| 127 | Resin A(20) | C-25 | 3/7 | KF414 | 30 |
| 128 | Resin A(20) | C-2/C-3 = 5/5 | 3/7 | KF414 | 10 |
| 129 | Resin A(20) | C-2/C-3 = 5/5 | 3/7 | KF414 | 30 |
| 130 | Resin A(20) | C-10 | 3/7 | D-56-1 | 10 |
| 131 | Resin A(20) | C-4 | 3/7 | D-56-1 | 50 |

TABLE 10-continued

| Example | Resin A | Resin C | Resin A/resin C mixing ratio | Silicone oil | Mass % of Silicone oil to resin A |
|---|---|---|---|---|---|
| 132 | Resin A(20) | C-2/C-5 = 3/7 | 3/7 | D-56-2 | 10 |
| 133 | Resin A(20) | C-2/C-10 = 7/3 | 3/7 | D-56-2 | 50 |
| 134 | Resin A(21) | C-18 | 3/7 | X-22-3000T | 30 |
| 135 | Resin A(22) | C-19 | 3/7 | X-22-9002 | 10 |
| 136 | Resin A(23) | C-24 | 3/7 | X-22-164B | 30 |
| 137 | Resin A(24) | C-25 | 3/7 | D-56-2 | 10 |
| 138 | Resin A(25) | C-2/C-3 = 5/5 | 3/7 | KF414 | 30 |
| 139 | Resin A(26) | C-2/C-3 = 5/5 | 3/7 | X-22-3000T | 10 |
| 140 | Resin A(27) | C-10 | 3/7 | X-22-9002 | 30 |
| 141 | Resin A(28) | C-5 | 3/7 | X-22-164B | 10 |
| 142 | Resin A(29) | C-2/C-5 = 3/7 | 3/7 | D-56-2 | 30 |
| 143 | Resin A(30) | C-2/C-10 = 7/3 | 3/7 | KF414 | 10 |
| 144 | Resin A(31) | C-26 | 3/7 | KF414 | 30 |

"Resin A" of Tables 8 to 11 means a resin A1 having a structural unit represented by the formula (A-1) and a structural unit represented by the formula (B), or a resin A2 having a structural unit represented by the formula (A-2) and a structural unit represented by the formula (B). "Resin C" of Tables 8 to 11 means a resin C having a structural unit represented by the formula (C). "Resin A/resin C mixing ratio" of Tables 8 to 11 means a mixing ratio (in a mass ratio) of a resin A and a resin C. "Silicone oil" of Tables 8 to 11 means a silicone oil having a structural unit represented by the formula (O-1), and at least one group selected from the group consisting of an alkyl group having 2 to 30 carbon atoms, a polyether group, an aralkyl group, an epoxy group, and an allyl group, or KF96. "Mass % of Silicone oil to resin A" of Tables 8 to 11 means the ratio in % by mass of a silicone oil contained in each charge-transporting layer to the total mass of a resin A1 and a resin A2 contained in the charge-transporting layer.

TABLE 11

| Comparative Example | Resin A | Resin C | Resin A/ resin C mixing ratio | Silicone oil | Mass % of Silicone oil to resin A |
|---|---|---|---|---|---|
| 1 | — | C-2/C-3 = 5/5 | — | — | — |
| 2 | — | C-2/C-3 = 5/5 | — | KF414 | 1 |
| 3 | — | C-2/C-3 = 5/5 | — | KF414 | 1 |
| 4 | — | C-2/C-3 = 5/5 | — | KF101 | 1 |
| 5 | — | C-2/C-3 = 5/5 | — | X-22-3000T | 1 |
| 6 | — | C-2/C-3 = 5/5 | — | X-22-9002 | 1 |
| 7 | — | C-2/C-3 = 5/5 | — | X-22-164B | 1 |
| 8 | — | C-2/C-3 = 5/5 | — | KF945 | 1 |
| 9 | — | C-2/C-3 = 5/5 | — | X-22-2516 | 1 |
| 10 | — | C-2/C-3 = 5/5 | — | D-4 | 1 |
| 11 | — | C-2/C-3 = 5/5 | — | D-9 | 1 |
| 12 | — | C-2/C-3 = 5/5 | — | D-19 | 1 |
| 13 | — | C-2/C-3 = 5/5 | — | D-29 | 1 |
| 14 | — | C-2/C-3 = 5/5 | — | D-33 | 1 |
| 15 | — | C-2/C-3 = 5/5 | — | D-38 | 1 |
| 16 | — | C-2/C-3 = 5/5 | — | D-42 | 1 |
| 17 | — | C-2/C-3 = 5/5 | — | D-45 | 1 |
| 18 | — | C-2/C-3 = 5/5 | — | D-48 | 1 |
| 19 | — | C-2/C-3 = 5/5 | — | D-51 | 1 |
| 20 | — | C-2/C-3 = 5/5 | — | D-54 | 1 |
| 21 | — | C-10 | — | KF414 | 1 |
| 22 | — | C-5 | — | KF414 | 1 |
| 23 | — | C-2/C-5 = 3/7 | — | KF414 | 1 |
| 24 | — | C-2/C-10 = 7/3 | — | KF414 | 1 |
| 25 | — | C-16 | — | KF414 | 1 |

TABLE 11-continued

| Comparative Example | Resin A | Resin C | Resin A/ resin C mixing ratio | Silicone oil | Mass % of Silicone oil to resin A |
|---|---|---|---|---|---|
| 26 | — | C-19 | — | KF414 | 1 |
| 27 | — | C-24 | — | KF414 | 1 |
| 28 | — | C-25 | — | KF414 | 1 |
| 29 | — | C-26 | — | KF414 | 1 |
| 30 | Resin A(1) | C-2/C-3 = 5/5 | 3/7 | KF96* | 1 |
| 31 | Resin A(1) | C-26 | 3/7 | KF96* | 50 |
| 32 | Resin A(12) | C-2/C-5 = 3/7 | 3/7 | KF96* | 1 |
| 33 | Resin A(16) | C-19 | 3/7 | KF96* | 50 |
| 34 | Resin A(16) | C-5 | 3/7 | KF96* | 1 |
| 35 | Resin A(20) | C-26 | 3/7 | KF96* | 50 |

TABLE 12

| Example | Potential variation (V) | Initial torque relative value | Torque relative value after making 5000 copies | Number average particle size (nm) |
|---|---|---|---|---|
| 1 | 35 | 0.72 | 0.76 | 450 |
| 2 | 41 | 0.62 | 0.67 | 520 |
| 3 | 47 | 0.55 | 0.58 | 660 |
| 4 | 52 | 0.51 | 0.55 | 740 |
| 5 | 37 | 0.71 | 0.73 | 460 |
| 6 | 53 | 0.51 | 0.56 | 810 |
| 7 | 38 | 0.73 | 0.76 | 480 |
| 8 | 54 | 0.54 | 0.56 | 790 |
| 9 | 35 | 0.73 | 0.76 | 440 |
| 10 | 53 | 0.52 | 0.55 | 730 |
| 11 | 36 | 0.72 | 0.74 | 420 |
| 12 | 54 | 0.51 | 0.52 | 790 |
| 13 | 37 | 0.71 | 0.76 | 460 |
| 14 | 53 | 0.51 | 0.53 | 810 |
| 15 | 38 | 0.73 | 0.74 | 480 |
| 16 | 54 | 0.54 | 0.59 | 790 |
| 17 | 35 | 0.73 | 0.79 | 440 |
| 18 | 53 | 0.52 | 0.56 | 730 |
| 19 | 36 | 0.72 | 0.78 | 420 |
| 20 | 54 | 0.51 | 0.54 | 790 |
| 21 | 36 | 0.72 | 0.73 | 460 |
| 22 | 54 | 0.51 | 0.54 | 810 |
| 23 | 37 | 0.71 | 0.73 | 460 |
| 24 | 53 | 0.51 | 0.56 | 810 |
| 25 | 38 | 0.73 | 0.76 | 480 |
| 26 | 54 | 0.54 | 0.56 | 790 |
| 27 | 35 | 0.73 | 0.76 | 440 |
| 28 | 53 | 0.52 | 0.55 | 730 |
| 29 | 36 | 0.72 | 0.74 | 420 |
| 30 | 54 | 0.51 | 0.52 | 790 |
| 31 | 37 | 0.71 | 0.76 | 460 |

TABLE 12-continued

| Example | Potential variation (V) | Initial torque relative value | Torque relative value after making 5000 copies | Number average particle size (nm) |
|---|---|---|---|---|
| 32 | 53 | 0.51 | 0.53 | 810 |
| 33 | 38 | 0.73 | 0.74 | 480 |
| 34 | 54 | 0.54 | 0.59 | 790 |
| 35 | 35 | 0.73 | 0.79 | 440 |
| 36 | 53 | 0.52 | 0.56 | 730 |
| 37 | 36 | 0.72 | 0.78 | 420 |
| 38 | 54 | 0.51 | 0.54 | 790 |
| 39 | 36 | 0.72 | 0.73 | 460 |
| 40 | 54 | 0.51 | 0.54 | 810 |
| 41 | 37 | 0.71 | 0.73 | 460 |
| 42 | 53 | 0.51 | 0.56 | 810 |
| 43 | 38 | 0.73 | 0.76 | 480 |
| 44 | 54 | 0.54 | 0.56 | 790 |
| 45 | 43 | 0.61 | 0.65 | 530 |
| 46 | 46 | 0.56 | 0.61 | 630 |
| 47 | 42 | 0.62 | 0.67 | 520 |
| 48 | 47 | 0.58 | 0.63 | 650 |
| 49 | 43 | 0.61 | 0.65 | 510 |
| 50 | 46 | 0.56 | 0.61 | 630 |

TABLE 13

| Example | Potential variation (V) | Initial torque relative value | Torque relative value after making 5000 copies | Number average particle size (nm) |
|---|---|---|---|---|
| 51 | 42 | 0.62 | 0.67 | 570 |
| 52 | 47 | 0.58 | 0.63 | 670 |
| 53 | 47 | 0.58 | 0.63 | 620 |
| 54 | 43 | 0.61 | 0.65 | 160 |
| 55 | 42 | 0.62 | 0.67 | 950 |
| 56 | 35 | 0.72 | 0.76 | 1620 |
| 57 | 37 | 0.71 | 0.73 | 210 |
| 58 | 47 | 0.58 | 0.63 | 650 |
| 59 | 43 | 0.61 | 0.65 | 530 |
| 60 | 46 | 0.56 | 0.61 | 1220 |
| 61 | 47 | 0.58 | 0.63 | 680 |
| 62 | 35 | 0.72 | 0.76 | 350 |
| 63 | 35 | 0.73 | 0.76 | 300 |
| 64 | 45 | 0.55 | 0.63 | 750 |
| 65 | 46 | 0.56 | 0.61 | 710 |
| 66 | 47 | 0.58 | 0.63 | 680 |
| 67 | 48 | 0.57 | 0.62 | 670 |
| 68 | 47 | 0.58 | 0.63 | 640 |
| 69 | 43 | 0.61 | 0.65 | 950 |
| 70 | 35 | 0.73 | 0.79 | 520 |
| 71 | 46 | 0.56 | 0.61 | 1010 |
| 72 | 54 | 0.54 | 0.59 | 1200 |
| 73 | 45 | 0.72 | 0.76 | 450 |
| 74 | 51 | 0.62 | 0.67 | 520 |
| 75 | 57 | 0.55 | 0.58 | 660 |
| 76 | 62 | 0.51 | 0.55 | 740 |
| 77 | 47 | 0.71 | 0.73 | 460 |
| 78 | 63 | 0.51 | 0.56 | 810 |
| 79 | 48 | 0.73 | 0.76 | 480 |
| 80 | 64 | 0.54 | 0.56 | 790 |
| 81 | 45 | 0.73 | 0.76 | 440 |
| 82 | 63 | 0.52 | 0.55 | 730 |
| 83 | 46 | 0.72 | 0.74 | 420 |
| 84 | 64 | 0.51 | 0.52 | 790 |
| 85 | 47 | 0.71 | 0.76 | 460 |
| 86 | 63 | 0.51 | 0.53 | 810 |
| 87 | 47 | 0.71 | 0.73 | 460 |
| 88 | 63 | 0.51 | 0.56 | 810 |
| 89 | 48 | 0.73 | 0.76 | 480 |
| 90 | 64 | 0.54 | 0.56 | 790 |
| 91 | 45 | 0.73 | 0.76 | 440 |
| 92 | 63 | 0.52 | 0.55 | 730 |
| 93 | 46 | 0.72 | 0.74 | 420 |
| 94 | 64 | 0.51 | 0.52 | 790 |
| 95 | 47 | 0.71 | 0.76 | 460 |

TABLE 13-continued

| Example | Potential variation (V) | Initial torque relative value | Torque relative value after making 5000 copies | Number average particle size (nm) |
|---|---|---|---|---|
| 96 | 63 | 0.51 | 0.53 | 810 |
| 97 | 47 | 0.71 | 0.73 | 460 |
| 98 | 63 | 0.51 | 0.56 | 810 |
| 99 | 48 | 0.73 | 0.76 | 480 |
| 100 | 64 | 0.54 | 0.56 | 790 |

TABLE 14

| Example | Potential variation (V) | Initial torque relative value | Torque relative value after making 5000 copies | Number average particle size (nm) |
|---|---|---|---|---|
| 101 | 45 | 0.73 | 0.76 | 440 |
| 102 | 63 | 0.52 | 0.55 | 730 |
| 103 | 46 | 0.72 | 0.74 | 420 |
| 104 | 64 | 0.51 | 0.52 | 790 |
| 105 | 47 | 0.71 | 0.76 | 460 |
| 106 | 63 | 0.51 | 0.53 | 810 |
| 107 | 47 | 0.71 | 0.73 | 460 |
| 108 | 63 | 0.51 | 0.56 | 810 |
| 109 | 38 | 0.73 | 0.74 | 480 |
| 110 | 54 | 0.54 | 0.59 | 790 |
| 111 | 35 | 0.73 | 0.79 | 440 |
| 112 | 53 | 0.52 | 0.56 | 730 |
| 113 | 36 | 0.72 | 0.78 | 420 |
| 114 | 75 | 0.51 | 0.54 | 790 |
| 115 | 45 | 0.72 | 0.73 | 460 |
| 116 | 47 | 0.73 | 0.78 | 810 |
| 117 | 52 | 0.62 | 0.67 | 530 |
| 118 | 63 | 0.51 | 0.53 | 810 |
| 119 | 68 | 0.56 | 0.61 | 940 |
| 120 | 72 | 0.51 | 0.53 | 1630 |
| 121 | 56 | 0.56 | 0.61 | 630 |
| 122 | 52 | 0.62 | 0.67 | 520 |
| 123 | 57 | 0.58 | 0.63 | 650 |
| 124 | 53 | 0.61 | 0.65 | 510 |
| 125 | 56 | 0.56 | 0.61 | 630 |
| 126 | 52 | 0.62 | 0.67 | 570 |
| 127 | 57 | 0.58 | 0.63 | 650 |
| 128 | 43 | 0.61 | 0.65 | 510 |
| 129 | 46 | 0.56 | 0.61 | 630 |
| 130 | 35 | 0.71 | 0.73 | 460 |
| 131 | 43 | 0.51 | 0.55 | 740 |
| 132 | 46 | 0.71 | 0.73 | 460 |
| 133 | 47 | 0.51 | 0.55 | 740 |
| 134 | 65 | 0.51 | 0.54 | 1050 |
| 135 | 68 | 0.56 | 0.61 | 940 |
| 136 | 72 | 0.51 | 0.53 | 1630 |
| 137 | 72 | 0.51 | 0.53 | 1430 |
| 138 | 43 | 0.61 | 0.65 | 160 |
| 139 | 43 | 0.61 | 0.65 | 530 |
| 140 | 46 | 0.56 | 0.61 | 630 |
| 141 | 48 | 0.56 | 0.61 | 940 |
| 142 | 46 | 0.56 | 0.61 | 630 |
| 143 | 43 | 0.61 | 0.65 | 530 |
| 144 | 57 | 0.58 | 0.63 | 650 |

TABLE 15

| Comparative Example | Potential variation (V) | Initial torque relative value | Torque relative value after making 5000 copies | Number average particle size (nm) |
|---|---|---|---|---|
| 1 | 25 | 1.00 | 1.00 | No domains formed |
| 2 | 120 | 0.32 | 1.01 | No domains formed |
| 3 | 117 | 0.45 | 0.99 | No domains formed |
| 4 | 112 | 0.52 | 1.11 | No domains formed |
| 5 | 146 | 0.34 | 1.05 | No domains formed |

TABLE 15-continued

| Comparative Example | Potential variation (V) | Initial torque relative value | Torque relative value after making 5000 copies | Number average particle size (nm) |
|---|---|---|---|---|
| 6 | 134 | 0.44 | 0.98 | No domains formed |
| 7 | 154 | 0.56 | 1.03 | No domains formed |
| 8 | 168 | 0.53 | 1.12 | No domains formed |
| 9 | 174 | 0.52 | 1.04 | No domains formed |
| 10 | 117 | 0.45 | 0.99 | No domains formed |
| 11 | 112 | 0.52 | 1.11 | No domains formed |
| 12 | 146 | 0.34 | 1.05 | No domains formed |
| 13 | 134 | 0.44 | 0.98 | No domains formed |
| 14 | 154 | 0.56 | 1.03 | No domains formed |
| 15 | 168 | 0.53 | 1.12 | No domains formed |
| 16 | 112 | 0.52 | 1.11 | No domains formed |
| 17 | 146 | 0.34 | 1.05 | No domains formed |
| 18 | 134 | 0.44 | 0.98 | No domains formed |
| 19 | 154 | 0.56 | 1.03 | No domains formed |
| 20 | 168 | 0.53 | 1.12 | No domains formed |
| 21 | 178 | 0.45 | 1.01 | No domains formed |
| 22 | 176 | 0.51 | 0.99 | No domains formed |
| 23 | 156 | 0.39 | 0.97 | No domains formed |
| 24 | 165 | 0.51 | 1.11 | No domains formed |
| 25 | 167 | 0.49 | 1.02 | No domains formed |
| 26 | 169 | 0.47 | 1.03 | No domains formed |
| 27 | 172 | 0.43 | 1.01 | No domains formed |
| 28 | 177 | 0.46 | 1.13 | No domains formed |
| 29 | 172 | 0.42 | 1.01 | No domains formed |
| 30 | 125 | 0.55 | 0.78 | 450 |
| 31 | 178 | 0.47 | 0.77 | 460 |
| 32 | 121 | 0.51 | 0.76 | 670 |
| 33 | 169 | 0.46 | 0.78 | 520 |
| 34 | 126 | 0.51 | 0.74 | 470 |
| 35 | 168 | 0.44 | 0.76 | 640 |

Based on comparison between Examples and Comparative Examples 1 to 29, the effect of persistently relaxing the contact stress cannot be attained in each of Comparative Examples because the charge-transporting layer contains neither the resin A1 nor the resin A2. This is revealed because torque is not reduced in the evaluation performed as described above at the initial stage and after outputting 5,000 copies.

Based on comparison between Examples and Comparative Examples 2 to 29, the effect of suppressing potential variation cannot be attained in each of Comparative Examples because the charge-transporting layer includes neither the resin A1 nor the resin A2. Furthermore, since almost no domains are formed, it is suggested that the silicone oil has moved to the surface and the interface with the charge-generating layer because the charge-transporting layer contains neither the resin A1 nor the resin A2. It seems that the silicone oil thus having moved to the interface with the charge-generating layer forms a barrier to charge movement, and hence the potential variation cannot be sufficiently suppressed.

Based on comparison between Examples and Comparative Examples 30 to 35, although the effect of persistently relaxing the contact stress can be exhibited in each of Comparative Examples, the potential variation is large. Furthermore, a matrix-domain structure is found in each of Comparative Examples. Accordingly, it is suggested that KF96 does not remain within domains although KF96 forms a matrix-domain structure together with the resin A1, the resin A2 and the resin C. It is probably because KF96 does not have a structure of the silicone oil of the present invention, affinity with the resin A1 and the resin A2 is so low that KF96 has moved to the surface and the interface with the charge-generating layer.

Based on these results, it seems that effects of persistently relaxing the contact stress and suppressing the potential variation can be exhibited in the present invention because the affinity between the silicone oil and the resins A1 and A2 is so high that the silicone oil can remain within the domains.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-263257, filed Nov. 30, 2012, and Japanese Patent Application No. 2013-224422, filed Oct. 29, 2013, which are hereby incorporated by reference herein in their entirety.

What is claimed is:

1. An electrophotographic photosensitive member comprising:

a support;

a charge-generating layer formed on the support; and a charge-transporting layer formed on the charge-generating layer;

wherein the charge-transporting layer is a surface layer of the electrophotographic photosensitive member, and the charge-transporting layer has a matrix-domain structure having:

a domain which comprises:

a silicone oil having a structural unit represented by the following formula (O-1), and at least one group selected from the group consisting of an alkyl group having 2 to 30 carbon atoms, a polyether group, an aralkyl group, an epoxy group, and an allyl group; and at least one resin selected from the group consisting of:

a resin A1 having a structural unit represented by the following formula (A-1) and a structural unit represented by the following formula (B), and a resin A2 having a structural unit represented by the following formula (A-2) and a structural unit represented by the following formula (B); and a matrix which comprises:

a resin C having a structural unit represented by the following formula (C); and a charge-transporting substance;

wherein a content of the structural unit represented by the formula (A-1) and the structural unit represented by the formula (A-2) is from 10% by mass to 40% by mass based on the total mass of the resin A1 and the resin A2, (A-1)

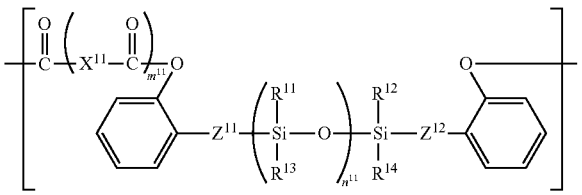

where, $m^{11}$ represents 0 or 1, $X^{11}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Z^{11}$ and $Z^{12}$ each independently represents an alkylene group having 1 to 4 carbon atoms, $R^{11}$ to $R^{14}$ each independently represents an alkyl group having 1 to 4 carbon atoms, or a phenyl group, and $n^{11}$ represents the repetition number of a structure within brackets, and an average of $n^{11}$ in the resin A1 ranges from 20 to 150, (A-2)

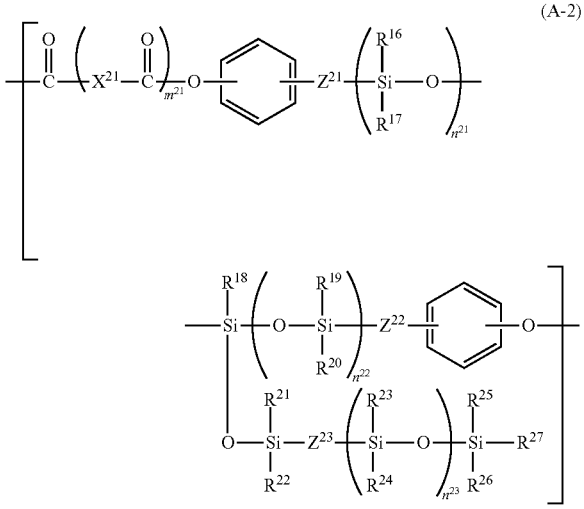

where, $m^{21}$ represents 0 or 1, $X^{21}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Z^{21}$ to $Z^{23}$ each independently represents an alkylene group having 1 to 4 carbon atoms, $R^{16}$ to $R^{27}$ each independently represents an alkyl group having 1 to 4 carbon atoms, or a phenyl group, and $n^{21}$, $n^{22}$ and $n^{23}$ each independently represents the repetition number of a structure within brackets, an average of $n^{21}$ in the resin A2 ranges from 1 to 10, an average of $n^{22}$ in the resin A2 ranges from 1 to 10, and an average of $n^{23}$ in the resin A2 ranges from 20 to 200, (B)

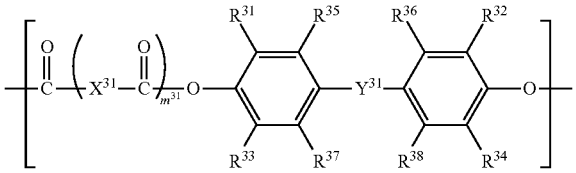

where, $m^{31}$ represents 0 or 1, $X^{31}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Y^{31}$ represents a single bond, a methylene group, an ethylidene group, a propylidene group, a cyclohexylidene group, a phenylmethylene group, a phenylethylidene group or an oxygen atom, and $R^{31}$ to $R^{38}$ each independently represents a hydrogen atom or a methyl group, (C)

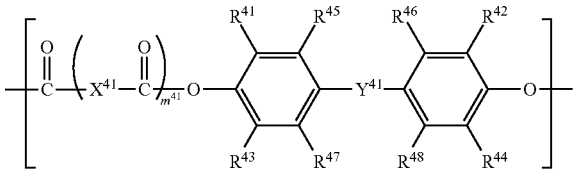

where, $m^{41}$ represents 0 or 1, $X^{41}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Y^{41}$ represents a single bond, a methylene group, an ethylidene group, a propylidene group, a cyclohexylidene group, a phenylmethylene group, a phenylethylidene group or an oxygen atom, and $R^{41}$ to $R^{48}$ each independently represents a hydrogen atom or a methyl group, (O-1)

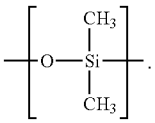

2. The electrophotographic photosensitive member according to claim 1, wherein a content of the silicone oil in the charge-transporting layer is from 1% by mass to 50% by mass based on the total mass of the resin A1 and the resin A2.

3. The electrophotographic photosensitive member according to claim 1, wherein the silicone oil has at least one group selected from the group consisting of an alkyl group having 3 to 25 carbon atoms, a polyether group having a structure represented by $(C_2H_4O)_a(C_3H_6O)_b$, a 1-phenylethyl group, a 2-phenylethyl group, a 2-methyl-2-phenylethyl group, a 1-phenylisopropyl group, a 2-phenylisopropyl group, a 3,4-epoxybutyl group, a 7,8-epoxyoctyl group, a 9,10-epoxydecyl group, a glycidyloxypropyl group and a 2-(3,4-epoxycyclohexyl)ethyl group, where a and b each represents the repetition number of a structure within brackets, and each independently ranges from 3 to 350.

4. The electrophotographic photosensitive member according to claim 1, wherein a content of the silicone oil is from 0.1% by mass to 20% by mass based on a total mass of all resins contained in the charge-transporting layer.

5. The electrophotographic photosensitive member according to claim 1, wherein the charge-transporting substance is at least one selected from the group consisting of a triarylamine compound, a hydrazone compound, a butadiene compound and an enamine compound.

6. The electrophotographic photosensitive member according to claim 1, wherein a content of the charge-transporting substance is from 25% by mass to 70% by mass based on a total mass of the charge-transporting layer.

7. The electrophotographic photosensitive member according to claim 1, wherein a total content of the resin A1 and the resin A2 is from 5% by mass to 50% by mass based on a total mass of all resins contained in the charge-transporting layer.

8. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device and a cleaning device.

9. An electrophotographic apparatus comprising:

the electrophotographic photosensitive member according to claim 1; and a charging device, an exposing device, a developing device and a transferring device.

10. A method for producing an electrophotographic photosensitive member comprising a support, a charge-generating layer formed on the support, and a charge-transporting layer formed on the charge-generating layer, the charge-transporting layer being a surface layer of the electrophotographic photosensitive member, the method comprising:

preparing a charge-transporting layer coating solution containing:

a silicone oil having a structural unit represented by the following formula (O-1), and at least one group selected from the group consisting of an alkyl group having 2 to 30 carbon atoms, a polyether group, an aralkyl group, an epoxy group, and an allyl group;

at least one resin selected from the group consisting of:

a resin A1 having a structural unit represented by the following formula (A-1) and a structural unit represented by the following formula (B); and a resin A2 having a structural unit represented by the following formula (A-2) and a structural unit represented by the following formula (B);

a resin C having a structural unit represented by the following formula (C); and a charge-transporting substance; and forming the charge-transporting layer by forming a coating film of the charge-transporting layer coating solution and drying the coating film, wherein a content of the structural unit represented by the formula (A-1) and the structural unit represented by the formula (A-2) is from 10% by mass to 40% by mass based on a total mass of the resin A1 and the resin A2, (A-1)

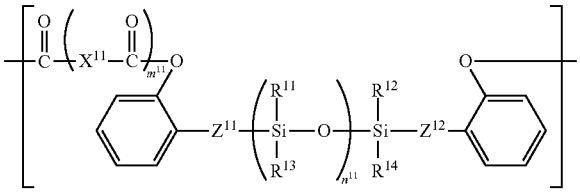

where, $m^{11}$ represents 0 or 1, $X^{11}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Z^{11}$ and $Z^{12}$ each independently represents an alkylene group having 1 to 4 carbon atoms, $R^{11}$ to $R^{14}$ each independently represents an alkyl group having 1 to 4 carbon atoms, or a phenyl group, and $n^{11}$ represents the repetition number of a structure within brackets, and an average of $n^{11}$ in the resin A1 ranges from 20 to 150, (A-2)

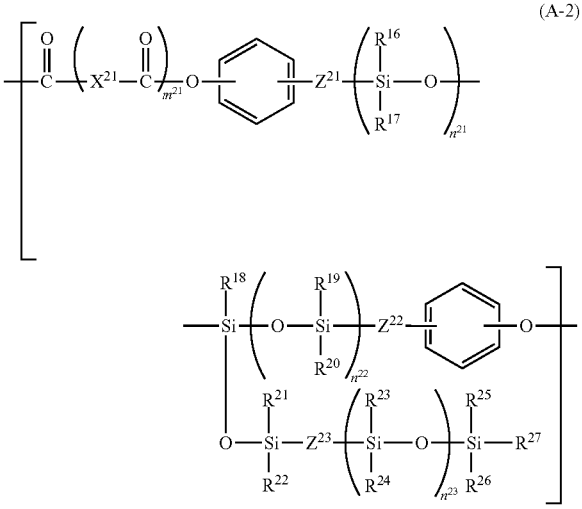

where, $m^{21}$ represents 0 or 1, $X^{21}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Z^{21}$ to $Z^{23}$ each independently represents an alkylene group having 1 to 4 carbon atoms, $R^{16}$ to $R^{27}$ each independently represents an alkyl group having 1 to 4 carbon atoms, or a phenyl group, and $n^{21}$, $n^{22}$ and $n^{23}$ each independently represents the repetition number of a structure within brackets, an average of $n^{21}$ in the resin A2 ranges from 1 to 10, an average of $n^{22}$ in the resin A2 ranges from 1 to 10, and an average of $n^{23}$ in the resin A2 ranges from 20 to 200, (B)

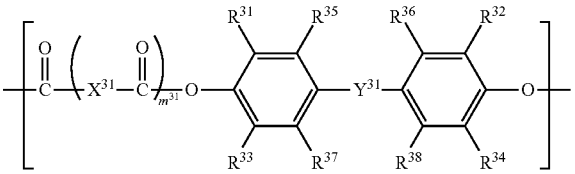

where, $m^{31}$ represents 0 or 1, $X^{31}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Y^{31}$ represents a single bond, a methylene group, an ethylidene group, a propylidene group, a cyclohexylidene group, a phenylmethylene group, a phenylethylidene group or an oxygen atom, and $R^{31}$ to $R^{38}$ each independently represents a hydrogen atom or a methyl group, (C)

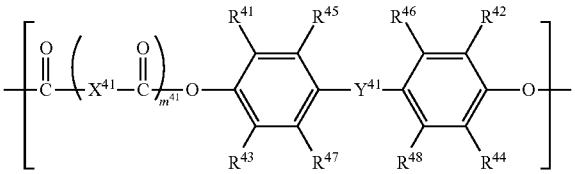

where, $m^{41}$ represents 0 or 1, $X^{41}$ represents an ortho-phenylene group, a meta-phenylene group, a para-phenylene group, a bivalent group having two para-phenylene groups bonded with a methylene group, or a bivalent group having two para-phenylene groups bonded with an oxygen atom, $Y^{41}$ represents a single bond, a methylene group, an ethylidene group, a propylidene group, a cyclohexylidene group, a phenylmethylene group, a phenylethylidene group or an oxygen atom, and $R^{41}$ to $R^{48}$ each independently represents a hydrogen atom or a methyl group, (O-1)

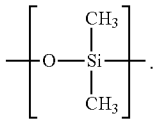

* * * * *